US006560893B1

(12) United States Patent
Bakalar

(10) Patent No.: US 6,560,893 B1
(45) **Date of Patent: *May 13, 2003**

(54) METHOD AND APPARATUS FOR HEAT TREATING WEBS

(76) Inventor: Sharon F. Bakalar, 510 Regenhard Ave., Moorestown, NJ (US) 08075

( * ) Notice: Subject to any disclaimer, the term of this patent is extended or adjusted under 35 U.S.C. 154(b) by 0 days.

This patent is subject to a terminal disclaimer.

(21) Appl. No.: 09/388,647

(22) Filed: Sep. 2, 1999

Related U.S. Application Data

(63) Continuation-in-part of application No. 08/973,263, filed as application No. PCT/US96/08783 on Jun. 5, 1996, now Pat. No. 5,996,835, which is a continuation-in-part of application No. 08/462,755, filed on Jun. 5, 1995, now Pat. No. 5,553,391.

(51) Int. Cl.[7] ..... F26B 11/02

(52) U.S. Cl. ..... 34/110; 34/273; 34/269

(58) Field of Search ..... 34/267, 268, 269, 34/273, 274, 117, 119, 122, 629, 637, 264, 445, 446, 491, 110, 108, 143, 144, 145, 306, 307, 308, 309, 311, 418, 419, 420, 421, 422, 423, 523, 548, 549, 550, 551, 611, 618; 700/90, 95, 117, 127, 207, 208

(56) References Cited

U.S. PATENT DOCUMENTS

| | | | | | |
|---|---|---|---|---|---|
| 2,225,166 | A | | 12/1940 | Erby | |
| 2,309,993 | A | * | 2/1943 | Skagerberg | 34/445 |
| 2,701,765 | A | * | 2/1955 | Codichini et al. | 34/121 |
| 2,987,305 | A | * | 6/1961 | Calhoun, Jr. | 34/124 |
| 3,174,228 | A | * | 3/1965 | Smith, Jr. | 34/119 |
| 3,729,180 | A | * | 4/1973 | Bourrel et al. | 432/228 |
| 4,324,613 | A | * | 4/1982 | Wahren | 162/111 |
| 4,498,864 | A | | 2/1985 | Roth | |
| 4,506,459 | A | * | 3/1985 | Swick | 34/110 |
| 4,543,940 | A | | 10/1985 | Krill et al. | |
| 4,688,335 | A | * | 8/1987 | Krill et al. | 34/273 |
| 4,693,015 | A | | 9/1987 | Hemsath | |
| 4,722,681 | A | * | 2/1988 | Smith | 431/7 |
| 4,782,747 | A | * | 11/1988 | Unger et al. | 100/37 |
| 4,918,828 | A | * | 4/1990 | Ruottu et al. | 34/273 |
| 5,276,327 | A | * | 1/1994 | Bossen et al. | 250/339.09 |
| 5,464,346 | A | * | 11/1995 | Derr et al. | 431/328 |
| 5,465,504 | A | * | 11/1995 | Joiner | 34/446 |
| 5,553,391 | A | * | 9/1996 | Bakalar | 34/110 |
| 5,666,741 | A | * | 9/1997 | Bubik et al. | 34/117 |
| 5,791,065 | A | * | 8/1998 | Gamble et al. | 34/110 |
| 5,842,285 | A | | 12/1998 | van der Veen | |
| 5,901,462 | A | * | 5/1999 | Rudd | 34/274 |
| 5,966,835 | A | * | 10/1999 | Bakalar | 34/267 |

FOREIGN PATENT DOCUMENTS

| | | | |
|---|---|---|---|
| DE | 3711887 A1 | * | 10/1988 |
| FR | 2699993 | | 12/1992 |
| WO | WO 96/39604 A1 | * | 12/1996 |

OTHER PUBLICATIONS

Rabinovich et al: "Effect of Heat Losses on Propagation of Stationary Low–Temperature Filtration Combustion Waves With Forced Filtration of The Gas–Oxidizer"; Fizika Goreniya i Vzyva (Combustion, Explosion, and Shock Waves) Jan.–Feb. 1984, vol. 20, No. 1, pp. 29–35 (Abstract Only).*

* cited by examiner

*Primary Examiner*—John G. Weiss

(57) ABSTRACT

A rotary cylinder for heat-treating a web bearing against its outer surface is heated by an internal stationary assembly of IR burner modules that heat lengthwise distributed annular bands of the cylinder, the burners having air-fuel mixture supplies that are regulated by cross-machine sensing of the web for controlling the web's cross-machine profile characteristics, the cylinder being part of a machine comprising a succession of like IR-burner-heated cylinders operated at respective optimal temperatures. The assembly of IR burners is removable from an end of its cylinder for service or modification. The interior of the stationary IR burner structure is protected against undue heat build-up.

11 Claims, 9 Drawing Sheets

METHOD AND APPARATUS FOR HEAT TREATING WEBS

The present invention relates to heated rotary cylinders for treating webs of material and to such cylinders integrated into a paper-making machine. This application is a continuation-in-part of my copending national application Ser. No. 08/973,263, filed Dec. 3, 1997, now U.S. Pat. No. 5,996,835, issued Oct. 19, 1999, said national application having been filed under Secs. 371 and 102(e) based on PCT application U.S. Ser. No. 96/08,783 filed on Jun. 5, 1996 and published as PCT Pub. No. WO 96/39,604 on Dec. 12, 1996. The PCT application is a continuation-in-part of my U.S. application Ser. No. 08/462,755 filed Jun. 5, 1995, now U.S. Pat. No. 5,553,391, issued Sep. 10, 1996.

The invention is described below as it applies to paper-making apparatus, because of its particular value in that context. However, in some respects the invention is applicable to other uses in which material to be heat treated is carried into contact with a heated cylinder.

BACKGROUND OF THE INVENTION

The Fourdrinier process of paper making involves a succession of phases. Initially a slurry of cellulose fibers in water is distributed on a screen and some of the water is drained off. A web is formed which is then transported by a felt or a succession of felts to pass a number of nip rollers in a press section. The felt and the formed web are squeezed between the nip rollers to extract water mechanically. In current practice, the web leaving the press section contains from 35 to 45% solids. The web then passes through a dryer section consisting of heated cylinders, in which the water content of the web is reduced by evaporation to roughly that of the finished paper.

Size coaters often follow the dryer section, followed by afterdryers and calenders, ending with the reel. The dryers and afterdryer sections may contain 60 or more heated cylinders. A felt is used to hold the paper firmly against many of the heated dryer cylinders, for assuring contact of the web with the heated surface and thereby promoting drying efficiency. Drying the web is the result of evaporation, caused by conduction of heat from the cylinders into the fibrous moisture-laden web. The term moisture-laden refers to water in all forms carried by the web, as free water or as moisture bound to the web's fibers.

In the U.S., roughly half the production is paperboard, which is formed into substantially thicker and heavier sheets than paper and newsprint. Many paperboard machines do not use papermaker's felts in the final dryer sections, because they are not necessary.

When the cold web enters the dryer section, fibers may be picked out of the web, adhering to the hot dryer cylinders. To suppress that effect, the temperature of the first series of dryer cylinders is comparatively low. Each successive cylinder's temperature is progressively higher until the sheet has been warmed up sufficiently for the web to encounter a hot dryer cylinder without concern for "picking" of fibers.

The following series of dryer cylinders effect a constant rate of drying. In this region the cylinders' temperature may be uniform. The paper making machine includes a falling rate zone that follows after the constant rate zone. The temperature of the steam in the successive cylinders of the falling rate zone is increased to 370° F. (187° C.). This is the practical upper limit for cylinders heated by steam under pressure. In the falling rate zone, the rate of evaporation declines progressively, due to the relatively dry condition of the web; in that condition, the web is a poor heat conductor, so that the transfer of heat to the web declines.

The highest pressure steam is typically delivered to the final dryer section, and a cascade steam system delivers reduced temperature steam upstream, to each cylinder of the series of dryer cylinders. It is complicated and expensive to provide steam at a pressure such that a specified high temperature is maintained in each of the cylinders. This is especially true when temperature changes are to be made.

Steam-heated cylinders are massive, both because of their large size and substantial wall thickness, They are usually made of gray cast iron for economy, and their walls are quite thick; e.g., 1" to 2" (25 mm. to 51 mm.) or more, to withstand the high internal steam pressure. A web may be 25 ft. (7.6 m.) wide, requiring cylinders that are slightly longer. The web may travel at 3300 ft./min. (1000 m./min.), or roughly 37 miles/hr. (60 km./hr.). That speed is impressive. The dryer section typically includes 60 cylinders. By any standard, the capital investment in a paper making machine is huge, and a considerable amount of space is needed.

Various types of paper making apparatus differ from that outlined above. For example, the "Yankee" type is characterized by inclusion of one very large diameter dryer cylinder; e.g., a diameter of 12 ft. to 18 ft. (3.6 m. to 5.5 m.). There, the wall thickness is particularly great, to withstand the pressure of the contained high-temperature steam and to allow for periodic grinding to restore surface smoothness.

The highest temperature of any steam-heated cylinder is limited by the corresponding pressure of steam that can be safely contained within the cylinder. The maximum internal steam temperature of a dryer cylinder (see above) is approximately 370° F. (187° C.) because of concern for the high steam pressure. It has been widely recognized that higher regulated temperatures, if feasible, would accelerate the drying process and would reduce substantially the number of dryer cylinders required.

Paper machine drying sections, worldwide, are almost universally heated by steam under pressure. Accordingly, it is appropriate to consider such apparatus in further detail, as a basis for appraising the advance in the art represented by the present invention.

As noted above, the temperature of a drying cylinder in a paper making machine is not determined by that which would be desirable from the point of view of performance, but by the limitations of cylinders heated by steam to withstand high pressures safely. This is evidenced by the large numbers of drying cylinders required in high-speed paper making machines or by the limited machine speed with lower temperature cylinders performing the drying function. Cylinders heated by steam under pressure have other significant limitations.

The external surface of a steam-heated cylinder responds slowly to an adjustment in steam pressure. This slow response time is manifested, for example, by the many minutes needed to bring the paper making machine from a cold start to full-speed operation. It is also manifested by the delayed change of a cylinder's external temperature in response to an adjustment in steam pressure.

It is virtually impossible to regulate the temperature of a cylinder wall from point-to-point along its length, for developing a desired temperature profile across the width of a web being dried. It is well-known that steam cylinder dryers are hotter at the ends, where no moist paper is present to absorb thermal energy from the cylindrical shell and from the end walls of the cylinder. Complicated, cumbersome arrangements have been proposed in an effort to compensate for the otherwise excessive cylinder temperatures at the margins of the web. These have been intended to control edge curl caused by unrestrained and excessive drying at the edges of the sheet. However, no easy, pitaical way has been found for varying the cross-machine temperature profile of a cylinder heated by steam under pressure.

The cross-machine moisture profile of a web emerging from the main dryer in a machine for producing paper and paperboard tends to develop non-uniformity not only at the margins but also at other portions of its width. This results from cumulative effects in the forming, press, and dryer sections. A web with moisture streaks is poorly suited to being coated as with size; moisture variations of the web cause the coating to be non-uniform. Also, a web whose cross-machine moisture profile is non-uniform has a tendency to render the calendering non-uniform.

The foregoing and other characteristics of a machine for making paper or paperboard, having dryer cylinders heated by steam under pressure, are impaired by some of the traits of the cylinder wall. Transfer of heat from the steam to the outer surface of the cylinder which contacts the web is impeded by many factors, including:

a) The considerable thickness of the cylinder wall needed for containing steam under the high pressure corresponding to the steam temperature, noting that the actual wall thickness is greater by a safety factor of 2.8 times that theoretically required for withstanding the steam pressure;

b) The poor heat conductivity of gray cast iron, the customary metal chosen for the cylinder wall, rather than a more expensive metal of superior heat conductivity;

c) A layer of condensate that forms and is distributed by centrifugal force over the cylinder's interior;

d) A layer of scale that develops over the cylinder's internal surface; and e) A temperature drop required to extract heat from the steam, by condensation.

The difference between the temperature of the steam and that of the cylinder's external surface represents a waste of energy.

The enormous mass of the cylinder wall and the high inertial load require a large value of installed horsepower capacity and a correspondingly high energy cost to drive the machine.

The above factors that impede energy transfer, plus the thermal inertia of the massive cylinder wall, contribute to a long response time of steam-heated cylinders. The same factors limit the speed and productivity of the machine.

In emergencies such as web breaks, the drying process is upset and the steam valves often fail to respond quickly, filling dryers with varying levels of condensate. The large amount of thermal inertia of the heavy-walled steam-heated cast iron cylinders imposes a long time delay should the dryers require maintenance or clearing.

Recognition of the problems and limitations of steam as the heat source in dryers of paper making machines has prompted proposals of alternative heating media.

It has been proposed that dryer cylinders in paper making machines should be heated internally by electric power; but electricity is inordinately expensive.

It has also been proposed that a dryer cylinder for paper making apparatus should be heated by a flame within the cylinder. Transfer of heat from the gaseous combustion products to the cylinder requires extensive areas of metal exposed to the hot gases and requires efficient removal of the combustion products after their heat has been extracted, so as to provide necessary space that is to receive newly emitted gaseous exhaust. See Hemsath et al., U.S. Pat. No. 4,693,015 issued Sep. 15, 1987, Calhoun U.S. Pat. No. 2,987,305 issued Jun. 6, 1961, and Bourrel et al., U.S. Pat. No. 3,729,180 issued Apr. 24, 1973.

U.S. Pat. No. 4,688,335 issued Aug. 25, 1987 to Krill et al. discloses use of a gas-fired radiant heat generator to heat a cylinder that acts on a web of fibers being pressed against the cylinder by a felt and a nip roller, the web having a large water content. The burner of Krill et al. is in the form of a ceramic fiber matrix shaped as a cylindrical shell. The cylinder's fiber matrix is to heat the cylindrical shell uniformly about its entire periphery. An air-fuel mixture is supplied to the interior of the shell. The mixture burns as it emerges everywhere from the shell. Unlike Hemsath, above, the energy of combustion in Krill et al. is intended to produce radiant heat. The heated web-engaging cylinder in Krill et al. operates at 600° F. to 800° F. (315° C. to 427° C.). That heat is so intense that some of the free water that is present in spaces between the fibers of the web is converted to steam, which blasts other free water through and out of the web. This process is called "impulse drying". Even though the supplied air-fuel mixture is adjustable, reduction of the air-fuel supply is limited by the lowest rate needed to sustain combustion. Noting that the type of burner used in Krill at al to produce radiant heat is in the form of a complete cylinder, the heat output would almost certainly be excessive for use in the usual drying section of a paper-making machine, even with its air-fuel supply adjusted downward to a minimum. Moreover, if the temperature of the cylinder were reduced by adjusting the supply of air-fuel mixture for developing a suitable operating temperature at full-speed operation of the apparatus, little if any latitude of downward adjustment would be available for realizing still lower cylinder temperatures as is required during slowed operation of the apparatus.

An earlier form of impulse dryer is acknowledged by Krill et al., referred to in U.S. Pat. No. 4,324,613 issued to Wahren. An external IR burner is used in Wahren to heat an arc of a cylinder's exterior to a high temperature. The newly formed web with its high moisture content is subjected to intense pressure between nip rollers and the just-heated segment surface of the cylinder to induce impulse drying. The hot segment of the cylinder's surface is chilled promptly in this process; it is reheated by the external IR burner during on-going rotation. The cylinder's exterior is a poor heat conductor, to avoid temperature-reducing conduction of heat away from the heated surface, thereby conserving the heat for transfer to the moisture-laden web.

In usual machines for making paper or paperboard, the moist web of fibers is dried by evaporation. The web is constrained against a large surface area of each of many steam-heated cylinders in succession. Despite alternatives that have been proposed for heating the dryer cylinders of apparatus for making paper and paperboard, steam under pressure continues to be the generally accepted heating medium.

SUMMARY OF THE INVENTION

A broad object of the invention resides in providing novel heated cylinders. Those cylinders have various applications, but they have attributes of distinctive importance in paper making apparatus. In one aspect of the invention, the heated cylinders (also called "shells") rotate; a web of material passes partway around each cylinder while maintaining heat-transferring contact with about half of the cylinder's surface. The cylinder has a horizontal rotary axis. A stationary non-rotatably disposed core in the cylinder includes at least one assembly of gas-fired infrared generators or IR burners which extend along and adjacent to the cylinder but which subtend only an arc or arcs of the cylinder's interior. The radiant heat of the IR burners is absorbed instantly and directly by that portion of the cylinder's inner surface which momentarily confronts the IR burners. In operation, the cylinder rotates constantly, but because the IR burners are assembled on the non-rotatably disposed core, the entire inner surface of the cylinder is exposed to the radiant heat. Thus, the cylinder is heated uniformly around its axis by IR burners that confront only part of the cylinder's interior.

The provision of IR burners extending all along the cylinder but which have only a limited arcuate extent is an aspect of the invention that has profound implications. It makes possible the construction of a cylinder that develops a specified maximum operating temperature, and in like manner it makes possible the construction of a succession of cylinders having either the same specified operating temperature or specified operating temperatures that differ, rising or declining cylinder-to-cylinder, as may be required in treating a web of material. This attribute of the novel cylinders is particularly valuable in paper making machines in which the dryer cylinders comprise the zones of increasing, constant, and falling rates of evaporation. The complements of IR burners in the cylinders are proportioned to develop coordinated operating temperatures of the cylinders at full-speed operation and with maximum supply of air-fuel mixture. In the zones where evaporation occurs at a falling rate, successive cylinders should have progressively higher heat outputs so as to maintain their effectiveness as dryers despite the increasing dryness and poorer heat conductivity from the cylinder into the web.

Each novel cylinder (and multiple cylinders of a machine) has the capacity of being operable over a wide range of temperatures, downward from a maximum, or upward to a maximum, by adjusting its supply rate of air-fuel mixture. This attribute is important in the dryer cylinders of paper making machines, when reducing the operating speed from an established norm and when increasing the speed to the established norm.

IR burners of a novel cylinder are supplied with a combustible air-fuel mixture, ordinarily a stoichiometric mixture of air and fuel. IR burners typically have the distinctive property of converting a large fraction of their energy of combustion into infrared radiation; this is in prominent contrast to burners that rely on transfer of heat by contact of hot combustible gases with surfaces to be heated. Various forms of IR burners are known, including those which have porous ceramic panels, porous sintered metal panels, metal mesh panels, and even ceramic tile plates having a pattern of discrete passages. The form of an IR burner that is best suited to the present purposes is that which is based on the technology of a long series of patents issued to Thomas M. Smith; e.g. U.S. Pat. No. 4,722,681, issued Feb. 2, 1988. See also Derr et al., U.S. Pat. No. 5,464,346, issued recently on Nov. 7, 1995. Such IR burners involve a panel comprised of a porous matrix of ceramic fibers and a binder. The matrix preferably contains material such as silicon carbide particles to enhance the infrared output efficiency of the burners.

The Smith burner is known as an "instant-off" burner. A person's hand can be placed on the previously radiating face about one second after an emergency shut-down. This rapid response, and low heat-storage reradiating material for the remainder of the stationary heating core, represent a low mass of thermal storage material opposite to the cylinder shell. Upon shutdown, this material cools rapidly; cooling is promoted by the powered removal of the exhaust. Without receiving heat from the heat source, the cylinder shell cools quickly in contrast to steam heat for cylinders. This rapid cool down promotes rapid shut-downs and facilitates any required dryer maintenance.

IR burners are operable over a range of supply of air-fuel mixtures. Throughout the range of supply variations, the combustion occurs at or just inside the exit face of the gas-permeable panel or emitter, heating the surface of the panel to incandescence. When the rate of supply exceeds the maximum, the combustion lifts away from the exit surface of the panel; when the supply drops below a minimum the combustion tends to recede toward the supply face of the gas-permeable panel and combustion ceases. There is a possibility of the burner backfiring; i.e., ignition of the air-fuel combustible supply may occur behind the burner's panel. The matrix components in the Smith patents are chosen to inhibit backfiring.

Characteristically, the heat output of an IR burner of any particular construction is dependent directly on its area. Increasing the heat output of any given IR burner is achieved by increasing the supply rate of its combustible mixture up to a maximum rate. IR burners are usually operable to produce adjustable rates of heat output. This trait is useful for turning down the temperature of a cylinder and its IR burners correspondingly, for example, when the paper making apparatus is being slowed down.

As will be seen, there are conditions when the air-fuel supply to an IR burner is adjusted somewhat for changing its heat output while the apparatus is in full speed operation. As noted below, part of the turn-down adjustment capability of IR burners of a cylinder is used to advantage for cross-machine profile control. However, it is desirable to reserve most of the turn-down adjustment capability of the cylinder's IR burners for use when the speed of the apparatus is to be reduced. Accordingly, the designation of the area of the cylinder's complement of IR burners should be related to its maximum or near-maximum rate of air-fuel supply. This, in turn, is accomplished by designating the arcuate extent of its IR burners of any particular design and efficiency. The terms "complement of IR burners" and "IR burner complement" means all of the IR burners with which a cylinder is equipped. The term "arcuate" signifies around the cylinder; "extent" signifies a linear dimension, not a number of degrees, so that "extent" refers to the width of the IR burners, or to their combined widths if multiple rows of IR burners are used.

IR burners can be made in the form of multiple sections. Each burner may have its own air-fuel supply regulator. However, even though multiple-section burners are used to advantage in the illustrative embodiment of the invention below, it is also feasible to utilize IR burners that are other-than-sectional. In concept, one or more very long IR burners extending along the cylinder may be used, as appropriate, instead of a row of many sectional IR burners.

Another object of this invention resides in utilizing IR burners made in sections to regulate the temperature of annular bands of a drying cylinder selectively, to match or be different from bands at other parts of the cylinder, for developing a desired "temperature profile" across the width of the web being treated. The ends of dryer cylinders that are heated by steam are hotter than the cylinder shell generally. This condition causes the margins of the web to develop "edge curl". Pursuant to one aspect of the invention, edge curl can be controlled by suitably adjusting the air-fuel supply to IR burner sections at the ends of a cylinder. In particular, the temperature of the ends of a cylinder heated by IR burners may have a tendency of tapering down, due to lessened burner-to-cylinder heat transfer or due to greater heat losses at the cylinder's ends. Different IR burner sections may be chosen or designed in advance to compensate for anticipated temperature deviations, especially declines in temperature at the cylinder ends. This compensation may also be achieved during operation by limited adjustment of the air-fuel mixture supply to the sectional IR burners at the ends of the cylinder or elsewhere as needed. However, as already noted, it is desirable to reserve most of the range of adjustment of the IR burners' air-fuel supply for use when the speed of the apparatus is being changed.

Equipping drying cylinders with sectional IR burners having separate air-fuel supply regulators affords an excellent means for developing desired profiles of heat output across the width of the web. The apparatus may include a scanning sensor, or multiple stationary sensors may be used for cooperation with respective incremental widths of the web identified with the burner modules inside the cylinder. The series of sensors or the scanning sensor is located downstream of the cylinder having the sensor-controlled burner; it responds to the moisture content of a related incremental width of the web. The sensor or sensors regulate the supply of the air-fuel mixture to individual modules for maintaining a specified moisture content at that portion of the width of the web.

A further object of the invention resides in providing an exhaust duct whose configuration is aimed at avoiding the build-up of hot exhaust gas such as might distort the cross-machine temperature profile of the cylinder. This is of particular concern in paper-making apparatus having cylinders that are very long. Recognizing that IR burners radiate a prominent portion of the heat resulting from combustion, nevertheless the exhaust gas of IR burners is significantly hot. In a horizontal cylinder heated by IR burners extending end-to-end within the cylinder and having a limited arcuate extent, an arcuate space or gap remains in the cylinder which is not occupied by IR burners. In achieving the above object of the invention, an exhaust duct extending end-to-end is located in that arcuate space, above the IR burners. The exhaust gas from the IR burners is strongly impelled upward by its buoyancy. The configuration of the exhaust duct is devised to counteract any tendency of the exhaust gas to develop higher temperatures at some regions along the cylinder than others.

A still further object of the invention resides in providing a cylinder heated by a longitudinally extending IR burner or complement of burners of limited arcuate extent, with means to conserve heat initially absorbed by portions of the cylinder while opposite the IR burners. After a portion of the cylinder that has just been heated leaves the IR burners, the newly heated area of the cylinder radiates heat towards the cylinder's interior. Pursuant to the just-mentioned object of the invention, heat-absorbing shields are placed all around the cylinder's interior in regions not occupied by the IR burners or the exhaust duct. These shields become hot and, as such, reradiate heat outward, toward the cylinder, where the reradiated heat is again absorbed by the cylinder.

The heat shields have a further function in the novel cylinder heated by the IR burners. There is a radial clearance space between the rotating cylinder wall and the stationary shields. That space constitutes a passage for the hot exhaust gases emitted by the IR burners; the shields direct the buoyant exhaust to the exhaust manifold. The buoyancy of the hot exhaust gas is strong at all points along the cylinder, thus providing an effective means for removing exhaust gas from the burners all along the length of the cylinder.

The novel cylinders, with their IR burners, have many prominent advantages over cylinders heated by steam, as is customary in the drying section of paper-making machines. Unlike cylinders heated by steam under pressure, where the maximum temperature is limited in practice by the safe pressure-resisting thickness of the cylinder wall, the temperature attainable by the novel cylinder is in no sense limited by the wall thickness of the cylinder. The wall of the novel cylinders may be comparatively thin and lightweight, consistent only with its mechanical requirements; and it may be made of a metal chosen for superior thermal conductivity. The IR burners can be adjusted rapidly to change the cylinder's operating temperature, and the cylinder wall does not appreciably retard the transfer of heat from the burners to the external surface. The comparatively thin and lightweight cylinders save installed horsepower and driving energy consumption. The IR burners that extend end-to-end along the novel cylinder may comprise sectional burners, whose air-fuel mixture may be regulated selectively and variably to provide and maintain the desired temperature profile across the width of the web being heated, a result not readily attainable with steam-heated cylinders. The novel cylinders are unencumbered by all the problems and consequences of condensate which characterize steam-heated cylinders. The cost and maintenance of high-pressure steam valves are eliminated. The novel cylinders enable the reduction of the required large number of cylinders heretofore heated by steam under pressure, or an increase in the speed and productivity of a paper making machine, or both a reduction in the number of cylinders and an increase in speed. A large number of steam-heated cylinders in the more common type of paper making machine can be replaced by a smaller number of novel cylinders heated to higher temperatures. Alternatively, by using cylinders proportioned for higher-temperature operation than steam-heated cylinders, a paper making machine having many cylinders could be operated at much higher speed, for greatly increased output.

The phenomenon of "picking" is mentioned above. A web emerging from the press section of a paper making machine is commonly cold. If that cold web were to engage a hot dryer cylinder, prominent picking would develop; fibers picked out of the web would stick to the hot cylinder surface. The novel dryer cylinders can readily be constructed to operate at relatively low and incrementally increasing temperatures selected to restrict the temperature differential between the incoming web and each cylinder engaged by the progressively warmer web, thereby to suppress picking. The number of novel IR burner-heated cylinders proportioned to operate at desired low temperatures can be limited by appropriately proportioning their complements of IR burners. A similar difficulty exists at the point where a size-coated web is to enter the afterdryer. The size press cools the web. An external IR burner is provided to apply heat directly to the web, for setting or congealing the size. Nevertheless, the size-coated web would tend to adhere to the first few afterdryer cylinders, an effect that is suppressed by providing cooler cylinders at the beginning of the afterdryer, merely by proportioning the IR burner complement of the novel cylinders appropriately to develop the desired low operating temperatures.

When leaving the main dryer and entering the size or coating station, the web should have a low and uniform cross-machine profile.

Using only steam dryers, sheets are often overdried deliberately to a very low moisture content to insure that the highest moisture across the machine is below the highest target of 4 to 6% sheet moisture by weight. This is performed at the exit end of the zone of falling-rate evaporation. Overdrying is performed in an effort to render inconsequential the non-uniform moisture profile. However, many extra dryer cylinders are needed to remove the last percentages of moisture. In a further effort to achieve coating uniformity, the web is exposed to direct radiation from sectional IR burners distributed across the web; these external IR burners are distributed upstream of the size press and regulated by a cross-machine moisture scanner. This correction of a non-uniform cross-machine moisture profile is achieved more effectively, and without extra space requirement, by a novel cylinder equipped with internal sectional burners and controlled by a cross-machine moisture sensor.

A similar drying condition occurs where the web enters the calender stack. A non-uniform moisture profile across the web can slow production and it tends to cause non-uniform calendering of the web. If no correction of the web is made at the end of the main dryer section, the web leaving the afterdryer has the combined moisture non-uniformities that accumulate in the main section plus non-uniform size or coating moisture.

The conductive heat transfer from a dryer cylinder to a moist web is self-leveling in nature, to a degree; this is because more heat is transferred to colder or wetter areas of the web surface. The novel dryer cylinder can be proportioned to operate at higher temperatures than feasible for steam-heated dryer cylinders. Higher temperature operation promotes cross-machine drying uniformity, due to the self-leveling effect of the conductive heat exchange. When the novel dryer cylinders are proportioned to operate at higher temperature than steam-heated dryer cylinders, not only do they provide faster drying but they also can provide moisture profile correction for especially streaked sheets. Several of these novel dryers in a short series replacing the steam-heated dryer cylinders, both at the end of the falling rate of the main dryer and at the end of the afterdryer section, can offer speed increases and moisture profile corrections well beyond such performance by external IR profilers in current use. Replacing external IR profilers can free valuable production space or it can free space for inserting other process equipment. Of course, if production space is not available, the IR burner of a novel dryer cylinder can have sectional IR burners regulated by a moisture profiling sensor.

The novel cylinders characteristically can readily be constructed to operate (at full speed and with maximum air-fuel supply to the IR burners) over a wide range of temperatures. In meeting the requirements of apparatus for making paper or paperboard, the cylinders can readily be proportioned for operation at the required low temperatures—such as 100° F. (55° C.) below the temperature of the constant rate cylinders in the main dryer section. Such low operating temperatures tend to cause large amounts of condensate to form inside steam-heated cylinders. Proportioning the novel cylinders for low temperature operation creates no problem; the arcuate extent of its IR burner is chosen accordingly.

At the opposite extreme, the novel cylinders can readily be proportioned for operation at higher temperatures than safety allows in steam heating practice.

Because the advantage of the novel cylinders over steam-heated cylinders is more marked at some stages of the paper drying apparatus than others, existing paper making and paperboard making apparatus may be improved by substituting novel cylinders in place of steam-heated cylinders that exist in actual paper making apparatus presently in service. And substitutions are distinctly advantageous where moisture profile correction is wanted, because internal modular IR burners can be arranged to heat particular annular bands of a cylinder (under control of moisture profiling sensing devices). The novel cylinders are also highly advantageous as substitutions where higher temperature cylinders are wanted than the available highest temperature steam-heated cylinders, for example at the end of the falling rate zone of the main dryer section and at the end of an afterdryer.

The novel cylinders are also distinctively useful when an external IR burner is used opposite to a novel cylinder for heating both surfaces of a web, also heating the interior of the web without increasing the required space occupied by the apparatus. Radiant energy from the external IR burner penetrates into and through the web. For example, it is known that thick and multi-ply paperboard webs can easily delaminate if heated too quickly, disturbing the newly-formed internal fiber bonds. The same web can easily withstand two-sided heating provided that sufficient moisture has been evaporated and the bonds are set by preceding treatments.

This combination conduction/infrared heat transfer can assist at the wet end of the dryer section, where picking is primarily caused in a cold, moisture-laden sheet being shocked on contact with a hot cylinder surface. Surface fibers loosen and adhere to the heated surface. Picking is reduced as the entering sheet temperature is increased before contacting the dryers, and subsequently the initial dryer temperatures can be increased. Lack of available machine space between the last wet press and dryer section may limit sheet preheating.

This high heat transfer, by conductive exchange from a cylinder to the web and by direct infrared web heating from an external IR burner can be used at the dry end, where thicker paperboard grades inhibit heat transfer more than than lighter grades of paper, and cause the falling rate drying period to be much longer. Most of these thick sheets are not processed with papermaker's felts in the last dryer section, allowing for an unobstructed exposure of the web which is required for this configuration. The external infrared heating rate can be easily balanced with the inner conductive heating rate to correct for undesirable warping and stresses. The paperboard sheet is not likely to delaminate in this final drying location.

It has been noted above that incremental portions or segments of the width of a web can be subjected to different heating and drying conditions, as by regulating the air-fuel supply to a series of IR burner modules extending across the web. A further object of the invention resides in providing a dryer with a cross-machine sucession of IR burner modules and means to control the air-fuel supply to such modules so as to develop either a uniform cross-machine profile or some other profile that may be desired.

This heating of the web by cylinder-to-web conduction and by direct radiation of heat to the web can also be used in the afterdryer section, after the size press or coating station, where the coating applied to the sheet is sticky and needs to be set quickly. The controllable heat transfer applied simultaneously to both sides of the sheet can speed coating coalescence and minimize unwanted absorption into the sheet. The individual face side and back side heat intensity may be somewhat reduced, but the double-sided heat treatment will be fast.

The following detailed description and accompanying drawings represent various aspects of the invention. While the detailed description relates to paper making machines, some of the novel aspects are applicable to machines for treating webs of other materials. Additionally, it is apparent that some aspects of the invention may be used without others; substitutions and modifications will be readily apparent to those skilled in the art. Consequently, the invention should be construed broadly, in accordance with its true spirit and scope.

ILLUSTRATIVE EMBODIMENTS OF THE PRESENT INVENTION

Figure 1:
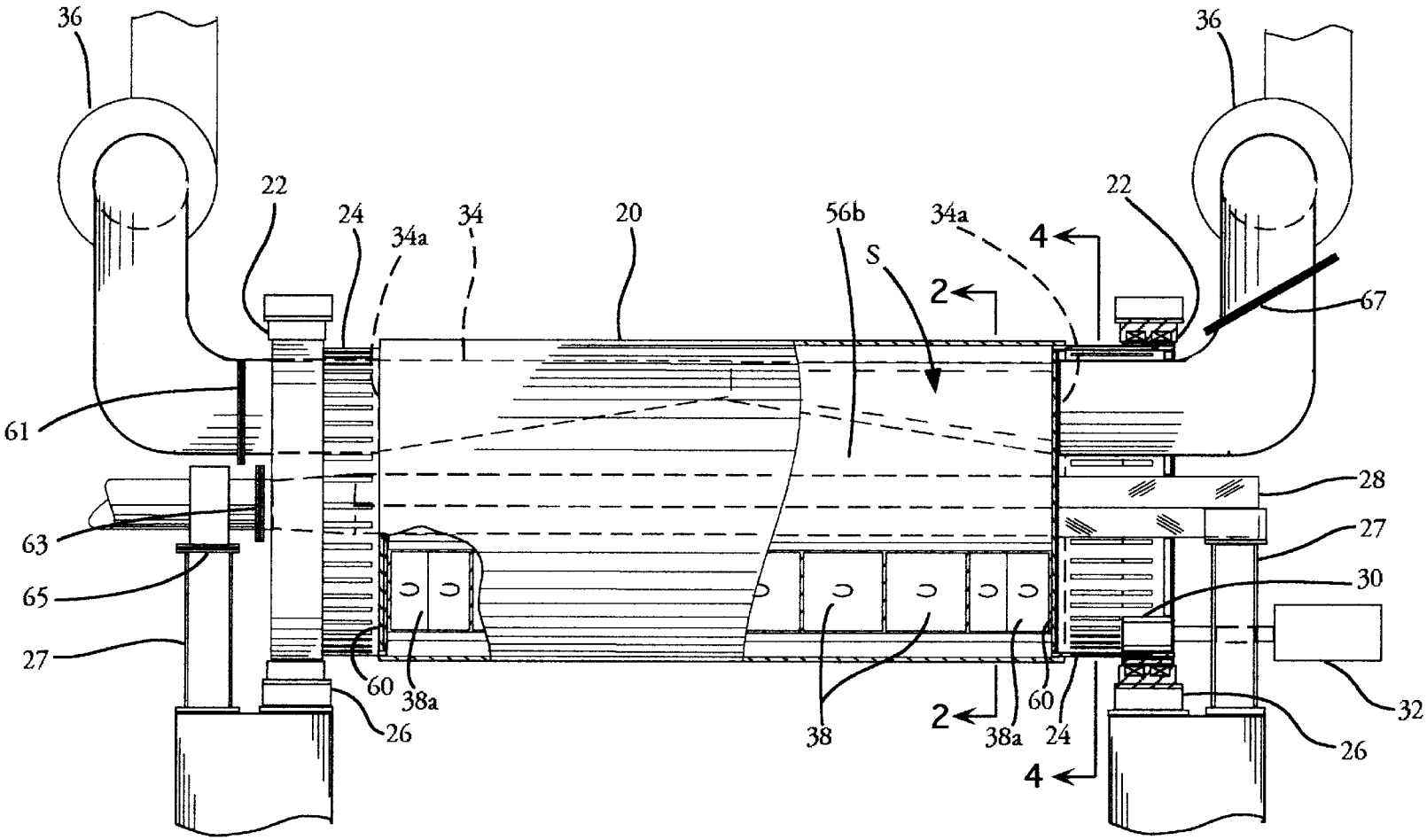
FIG. 1 is a lateral view, partly in cross-section, of a novel dryer cylinder, being an illustrative embodiment of certain aspects of the invention.

A novel heated cylinder is shown in FIG. 1, usefull particularly in the dryer section of apparatus for making paper or paperboard. The term "cylinder" is usually used herein to refer to the hollow cylindrical component 20 which (see below) has a relatively thin wall and which, accordingly, may be called a shell, but the term "cylinder is also used to refer to one or more complete units, a shell and its appurtenances, that constitute a dryer section or a complete paper-making machine. The meaning of "cylinder" will be understood readily from the context in which it is used. Thus, a heated cylinder may comprise a rotary shell and all the the internal statinary structure S (FIGS. 1 and 2) that heats the shell.

Figure 1A:
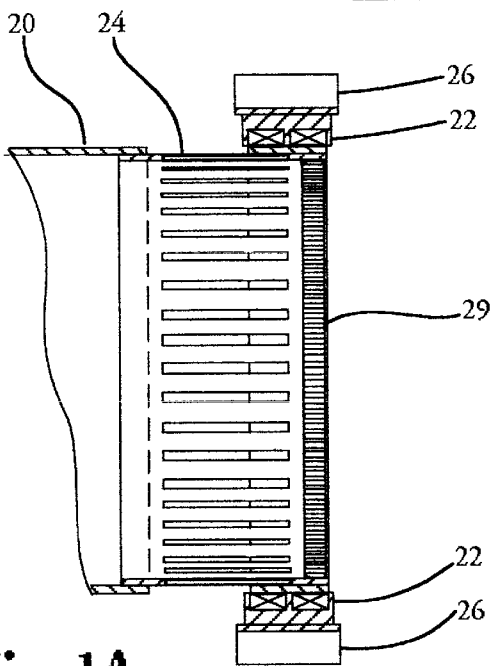
FIG. 1A is a cross-section of the right-hand end portion of the cylinders in FIGS. 1 and 5, omitting stationary apparatus within the cylinder.

In FIG. 1, cylinder (or shell) 20 is supported at its opposite ends by bearings 22 which may be as large as the cylinder's diameter. Cylinder 20 has a relatively thin wall and is made of metal chosen for superior thermal conductivity, for example an aluminum bronze alloy. For a cylinder of 215" (5.5 m.) long and 5 ft. (1.5 m.) in diameter, its wall thickness may be 0.5" (1.3 cm.) for example, whereas such a cylinder when made of cast iron typically may be 1"–2" (2.5 cm.–5 cm.) thick. Collars 24 extend from the ends of cylinder 20 to the inner races of bearings 22 to support the cylinder. The collars have a pattern of slots or other cut-out shapes to provide some heat isolation between cylinder 20 and its supporting bearings 22. Conventional cooling means (not shown) may be provided for the bearings. Frame members 26 at the ends of the cylinder support the outer races of the bearings 22, and frame plates 27 support the ends of an axial tube 28 extending along the cylinder's axis. Tube 28 in this embodiment serves two purposes. It is a structural support for the entire stationary assembly located in the cylinder's interior, and it is a conduit for the air-fuel supply. The inner race of each bearing 22 is formed as a ring gear 29 (FIG. 1A), to be driven by pinion 30 and motor 32. This drive is a diagraunatic representation of a drive means for rotating cylinder 20. In an entire drying section, a more sophisticated drive is contemplated, such as that used in practice for coordinately turning all of the cylinders in processing a continuous paper web.

Extending along the top of cylinder 20, inside the cylinder, is an exhaust duct 34 having dual exhaust exits 34*a* at the ends of the cylinder. IR burner modules 38 (collectively an "IR burner") produce exhaust gases which are drawn out of the duct by exhaust blowers 36.

Figure 3:
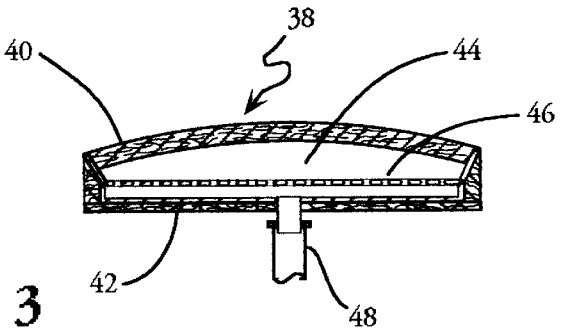
FIG. 3 is a portion of FIG. 2 drawn to still larger scale.

An IR burner module 38 in FIG. 3 is of any suitable light-weight design like those in U.S. Pat. No. 4,722,681 and U.S. Pat. No. 5,464,346 (supra). It comprises a gas-permeable matrix 40 of ceramic fibers and a binder, whose composition may be varied as described in the '681 patent incorporated here by reference. A rear wall 42 of metal externally covered by insulation is sealed to the edges of the matrix, forming an intake plenum 44. The plenum is divided by a partition 46 having apertures enabling the air-fuel mixture from inlet connector 48 to reach the inner baffled compartment of the plenum; i.e., the compartment located above the partition in FIG. 3. The air-fuel mixture passes through the matrix and it burns as it emerges, heating the surface of the matrix to incandescence. The matrix can be loaded with silicon carbide particles to improve the IR emissivity of the panel.

No novelty is asserted here for this or any particular form of IR burner; the drawing and this description are provided for identifying IR burners as distinguished from air-fuel burners that are relied on primarily to emit heated gaseous products of combustion. Ideally the outer surface of the matrix is cylindrically curved as shown, corresponding to cylinder 20, or the matrix may be flat.

Module 38 in FIG. 1 is one of a row of burner modules which collectively constitutes an IR burner that extends the length of cylinder 20. The burner modules of a row may be aligned as shown, or they may be staggered; e.g., like the squares of a checkerboard, collectively being continuous along the length of the cylinder. That row of modular, sectional burners extends around only an arc of the cylinder's interior 20*b*. In cylinders requiring more heat, more rows or wider IR burners may be used than the two rows shown in FIG. 2.

In operation, the web W (FIG. 2) contacts roughly 270° of the cylinder's outer surface 20*a*. Some of the moisture in the web is removed solely by evaporation during the brief contact period of the web with the cylinder. The degree of drying that takes place depends on the paper web speed and the cylinder temperature.

Many factors determine the temperature of the cylinder, prominently including the cylinder's efficiency in absorbing the radiant heat emitted from the IR burner and the efficiency of the IR burner as a generator of infrared radiation. Two main variables determine the cylinder temperature: the width of the burner modules, and the rate of their supply of air-fuel mixture. Burners of the type in the '681 patent and others issued to Thomas M. Smith are operable over a wide range of air-fuel mixture supply rates, resulting in a heat output ratio of 4:1 between maximum and minimum. When the burner surface achieves a maximum temperature, receiving air-fuel mixture at maximum rate without flame lift-off from the emitter surface, the burner heat output is at a maximum.

The cylinders are ordinarily maintained at their specified maximum temperature when the paper machine is in full-speed operation. It is advantageous to be able to modify the temperature over the full range of control of the air-fuel mixture supply when the machine is being brought up to speed from a cold start and it is particularly helpful when the machine is slowing down. It is desirable to reserve as much of the 4:1 ratio of heat output as possible, for that purpose. Accordingly, the arcuate extent of the IR burner is chosen for a cylinder that is to have a specified maximum temperature at the full operating speed.

It is necessary at times to reduce the maximum temperature attained by a cylinder to a less-than-maximum temperature, as an adjustment. For example, an installed cylinder equipped with its complement of IR burner modules may develop a higher maximum temperature than desired at a particular location in the apparatus. The available cylinder can be adapted to operate at a lower desired peak temperature simply by reducing the peak supply rate of air-fuel mixture. That adjustment detracts from the 4:1 turn-down ratio of the IR burner. This reduction in the available turn-down ratio can be mitigated, and the turn-down can in effect be extended by electronically regulating the "on" times of the burners of some of the cylinders during slowed operation of the paper-making machine.

The maximum temperature of a cylinder heated by IR burners of any particular design and efficiency is directly related to the collective widths or arcuate extents of its IR burners.

Electrically controlled valves 50 (FIGS. 2 and 6) regulate or modulate the supply of air-fuel mixture provided to burner modules 38 from the axial supply tube 28. A whole row of burner modules may be supplied with air-fuel mixture by a common valve 50; or multiple valves may be used for groups of burner modules or individual modules in each row. To special advantage, IR burner modules 38*a* at each end of the cylinder may be somewhat wider than modules 38 or modules 38*a* may differ in other respects from module 38 so as to have a greater heat output per unit of length along the row of modules than module 38 by techniques in the '681 patent. Modules 38 and 38*a* may have separate regulating valves enabling those burner modules to be adjusted separately. That additional heat is to compensate for lessened heat transfer to the cylinder from the end IR burner module 38*a* and for extra heat dissipation and other effects that may occur at the cylinder ends. Using modular or sectional IR burners confronting the ends of the cylinder as a means for heating the cylinder makes it practical to achieve cylinder-end temperature compensation. The use of separate modules 38 and respective valves 50 and valve controls makes it possible to correct for uneven moisture profiles across the web. In practice, the row of IR burner modules may be made somewhat longer than the cylinder, as one means of compensating for ordinarily declining temperatures at the ends of the cylinder. Accordingly, the phrase "end-to-end" used in relating the row of IR burners to the length of the cylinder should not be read literally.

Sensors have been used to monitor the characteristics of the paper web from point-to-point across the web. Scanning sensors are available, or fixed sensors may be used. For example, see U.S. Pat. No. 5,276,327 issued Jan. 4, 1994 to Bossen et al. Deviations from uniformity in the moisture content of the web at various parts of its width can be corrected automatically by using signals from the sensors for selectively controlling the adjustment of the air-fuel mixture supply valves 50 of modules 38 as well as modules 38*a*. Thus, if a sensor were to detect excessive dryness at a margin of the paper web, the valve controlling the rate of air-fuel mixture supplied to the burner modules 38*a* may be adjusted separately for correcting that condition.

Valves 50 are also adjustable collectively—for all of the IR burner modules of a cylinder and for all of the cylinders of a dryer series—when the speed of the apparatus is reduced, as may be needed, to avoid overheating of the web during slowed operation. The hot portions of the IR burners inherently have low thermal inertia and the comparatively thin wall of cylinder 20 also has a relatively small amount of thermal inertia. Accordingly, the temperature change of the cylinder in response to adjustment of its air-fuel supply is rapid. Rapid response of the cylinder to altered operation of its IR burner or burners is extremely valuable, especially in case of emergency stops and sheet breaks. This rapid response to adjustment is an important point of contrast, compared to the slow response to emergency stops of thick-walled cylinders heated by steam under pressure.

Burner modules 38 are part of the stationary structure that is disposed non-rotatably inside the cylinder. Structural frame 52 (FIG. 2) unifies the burners and the structural/air-fuel supply tube 28. Exhaust duct 34 is united to transverse panels 54 which, in turn, are united to frame braces 52 and to tube 28. Transverse panels 54 are provided at spaced-apart locations along the length of the cylinder. Tube 28 is the ultimate support of the entire stationary assembly inside cylinder 20.

Figures 4, 6:
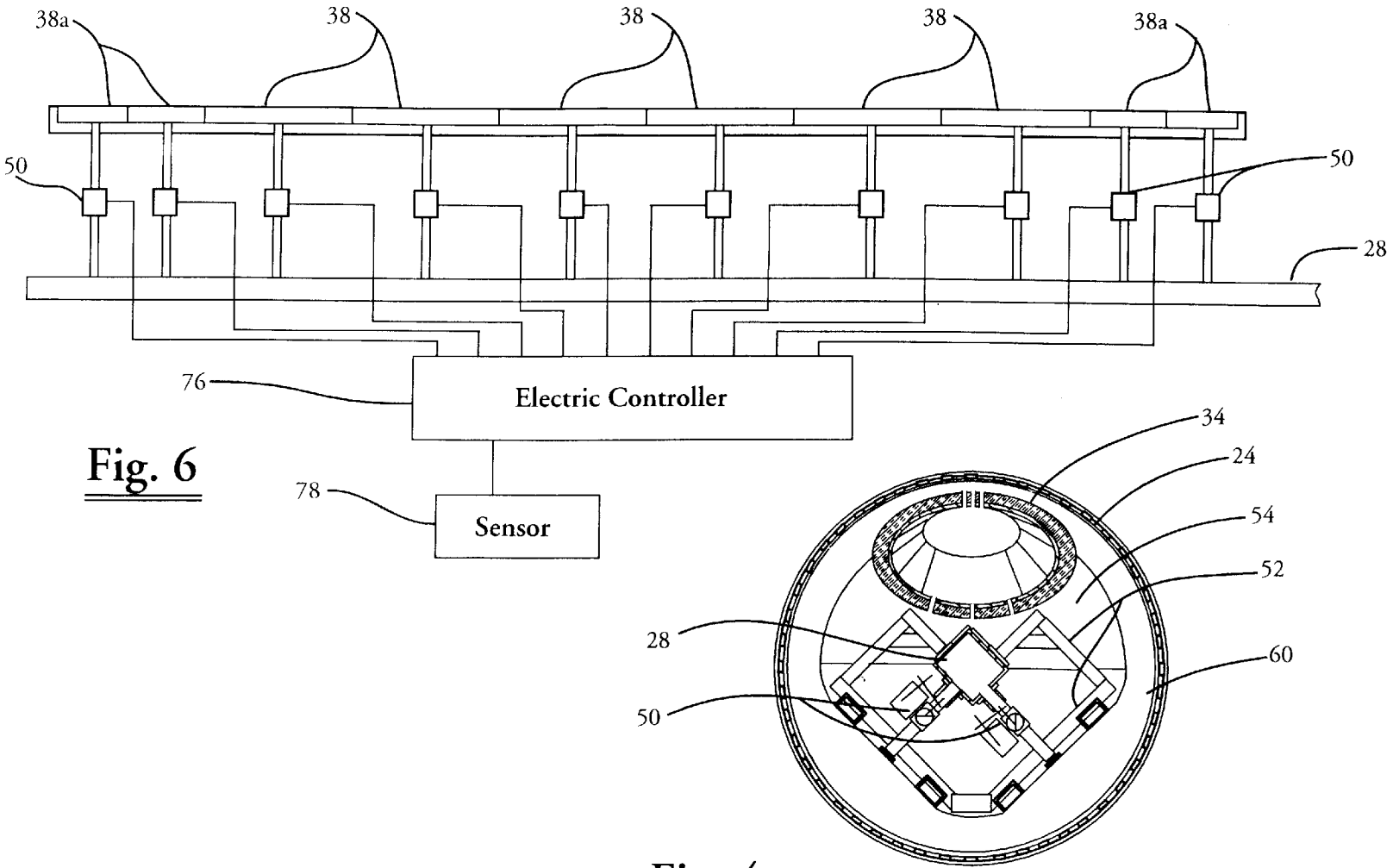
FIG. 4 is another cross-section of the novel cylinder at the plane 4—4 of FIG. 1.
FIG. 6 is a diagrammatic illustration of a row of IR burner modules of the cylinder in FIG. 1 or FIG. 5, with means for controlling the air-fuel supply of each of those modules.

The entire stationary core structure inside the cylinder is removable axially, for repairs or for substitution of IR burner modules of different arcuate extent in case a different maximum temperature should be needed for any particular cylinder. This may be accomplished by initially removing all impediments; i.e., removing frame 27 at the right in FIG. 1 which supports structural tube 28; and removing drive 32, and removing generally annular cover 60 (FIGS. 1 and 4). Several couplings are then disconnected: coupling 61 in the exhaust passage; coupling 63 of the air-fuel supply line; coupling 65 of frame 27 at the left in FIG. 1; and coupling 67 in the exhaust line at the right in FIG. 1. Tube 28 is to be firmly supported at its ends while the various connections are being released; a special sling or a fork-lift may be used to provide such support. Finally, the whole core structure is withdrawn, to the right in FIG. 1, being guided in this motion by a suitably supported rod (not shown) extending through the length of tube 28. The details of the cylinder and its inner core structure to facilitate assembly and dis-assembly may be varied extensively by those skilled in the art.

As an alternative the IR burners and their valves and air fuel supply pipes may be fabricated as a unitary assembly, separate from the main support beam 28, exhaust manifold 34, and shield 56*a* and 56*b*. Beam 28 may be used as a support rail and the unitary assembly may have supporting wheels that ride on beam 28. Such alternative assembly is removable from one end of the cylinder. Whether this modification of the core structure or the structure shown is used, the clearance space 58 between the cylinder and the core structure facilitates such removal and replacement of the IR burner assembly. In any case, the heat-isolating structures that separate bearings 22 from the cylinder should not intrude into the path of removal of the core structure from the cylinder.

Figure 2:
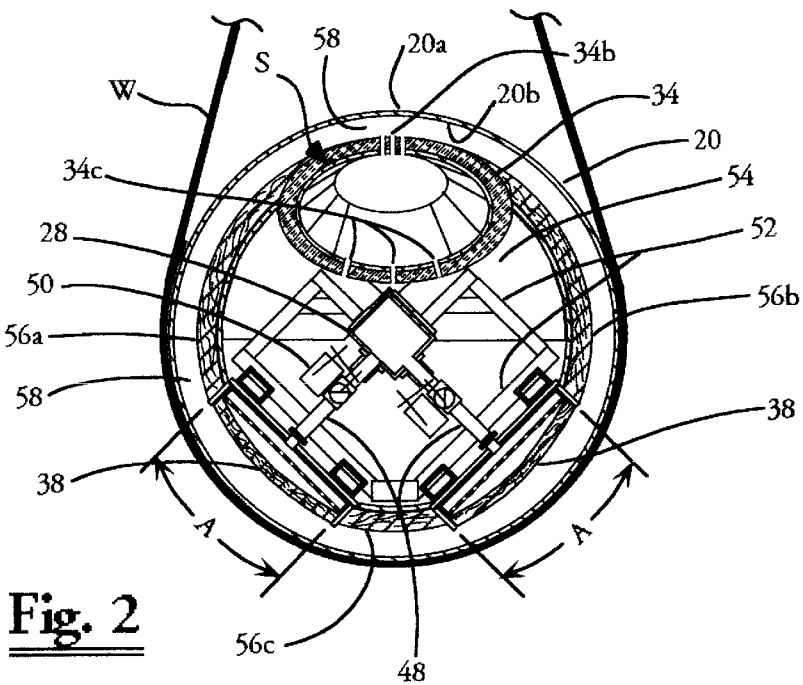
FIG. 2 is a cross-section of the novel dryer cylinder at the plane 2—2 of FIG. 1, FIG. 2 being drawn to a larger scale than FIG. 1.

Heat radiated by the IR burners is absorbed instantly by that portion of cylinder 20 that is opposite to the burners at any moment. Electrical interlocks, not shown, provide assurance that the IR burners operate only while the cylinder turns. As the cylinder turns, all parts of the cylinder's inner surface pass the IR burners. That inner surface is blackened to promote heat absorption. All parts of the cylinder's wall are uniformly heated, around and along the cylinder. The blackened inner surface inherently acts as a black body; not only does it absorb radiant heat from the IR burners but being hot, it also radiates heat. The reradiated heat could be damaging to the stationary assembly within the cylinder and it would ordinarily be wasteful. Composite heat shield 56*a*, 56*b* and 56*c* (collectively) occupies the gap between the two rows of IR burners in FIG. 2 and two other gaps, between each row of IR burners and the exhaust duct. Those heat shields, for example, are made of fibrous ceramic insulation backed by reinforcing sheet metal. They are united to the exhaust duct, the IR burner modules, and transverse panels 54. FIG. 2 shows two IR burners; i.e., two rows of IR burner modules 38 that extend the length of the cylinder, end-to-end. The combined width (arcuately) of the IR burners is chosen to provide a desired maximum heat output and corresponding maximum cylinder temperature. As is apparent, the rows of IR burner modules and the exhaust manifold and heat shields 56*a*, 56*b*, and 56*c* occupy respective sectors of a cylindrical assembly which constitutes the exterior of the stationary or non-rotary structure.

Exhaust duct 34 is configured to enable blowers 36 to remove the gaseous products of combustion emitted by the burners in a manner that avoids accumulation of hot exhaust at any location. While most of the heat developed by the IR burners is transformed into radiant heat, the gaseous products of combustion are also hot. Any accumulation of hot exhaust that might interfere with the temperature uniformity of cylinder 20 along its length should be avoided.

It may be noted that the exhaust gas is relatively clean. It is reusable elsewhere, as in the drying section, for even higher drying energy efficiency.

The gaseous products of combustion have very strong buoyancy because they are quite hot; they rise rapidly in the space 58 between the cylinder 20 and the stationary composite shield 56*a*, 56*b*, and 56*c* within the cylinder. A portion of the heat from the rising gases is transferred to the inner surface of the cylinder, adding by convention to the by converatiant heat absorbed by the blackened inner surface of the cylinder. Some clearance between the cylinder and the burner modules 38, and some clearance between the cylinder and all the heat shields are a mechanical necessity but it is not a critical dimension. A clearance space of 4" to 6" (102 mm. to 152 mm.) between the cylinder and the stationary assembly is appropriate. The exhaust gas from burner modules 38 rises rapidly in that clearance space to duct 34. Holes or slots 34*b* in the top of the duct admit the exhaust into the duct for removal by blowers 36.

In FIG. 1, the cross-section of duct 34 increases from a minimum midway along cylinder 20 to the exhaust exits 34*a* at the opposite ends of the cylinder. Exhaust emitted by a burner module 38 which is located midway along the cylinder, enters the duct midway along the cylinder. That exhaust is drawn by fans 36 to exhaust exits 34*a* of the duct. Exhaust from other burner modules at locations progressively closer to the exhaust exits 34*a* enters the duct at points correspondingly closer to ends of the cylinder. The progressive enlargement of the duct's cross-section promotes uniform exhaust removal. The apertures 34*b* are also of a configuration promoting uniform exhaust removal. To that end, if apertures 34*b* are slots, they are progressively wider in accordance with their proximity to the closer one of the two exhaust exits 34*a* of the duct. If the apertures are holes, they are larger and/or more numerous with decreasing distance from the closer one of two exhaust exits 34*a* of the duct. The varied cross-sectional area of the duct and the varied duct openings that admit the exhaust into the duct act variously to provide impedences to the flow of the gaseous exhaust, so as to equalize flow rates of exhaust into and along duct 34.

Alternatively, a duct of uniform cross-section may be used, provided that the pattern and sizes of apertures 34*b* are proportioned to equalize the flow of exhaust into and along the duct.

Duct 34 also has openings 34*c* for admitting air from the cylinder's internal volume, to avoid a build-up of heat in that region. More precisely, the internal volume wherein a build-up of heat is avoided by entry of cooler air into the interior and exit of air from the interior via openings 34*c* may be called "the core volume"; it is bounded circumferentially by the generally cylindrical wall that comprises the IR burners 38, the shield which comprises segments 58*a*, 58*b* and 58*c* and the exhaust manifold 34, as seen in FIG. 2. Annular cover 60 in FIG. 4 advantageously forms a barrier at the end of exhaust space 58 at each end of the cylinder. Barrier 60 is fixed to the stationary assembly inside the cylinder. Air may enter the cylinder's interior through the open areas of covers 60 at both of the cylinder's ends to make up for air that leaves the interior via openings 34*c*. Some of the heat of combustion in the gas-receiving space 58 and some of the heat that is reradiated inward from the inner heat-absorbing surface of the cylinder penetrate the cylindrical assembly of the IR burner modules, the heat shields, and the exhaust manifold. That heat enters the internal volume of the stationary assembly. Consequently, a build-up of heat mentioned above would occur but for the cooling air which enters cylinder 20 via covers 60 (FIG. 4) and which is drawn out of the interior via openings 34*c* (FIG. 2) in the exhaust manifold. The cooling air protects all of the internal stationary structure against overheating, and supplements insulation 42 (FIG. 3) in protecting the plenums against excessive build-tip of heat.

Duct 34 in FIG. 1 extends from the midpoint of the cylinder to exhaust ends 34*a* of the duct and to corresponding blowers 36. A barrier across duct 34 may be provided at its midpoint if desired.

While no ignition means is shown in the drawings, it should be understood that conventional ignition devices such as a pilot burner or burners, or electric ignition devices will be incorporated in the stationary structure, at suitable places.

Figure 5:
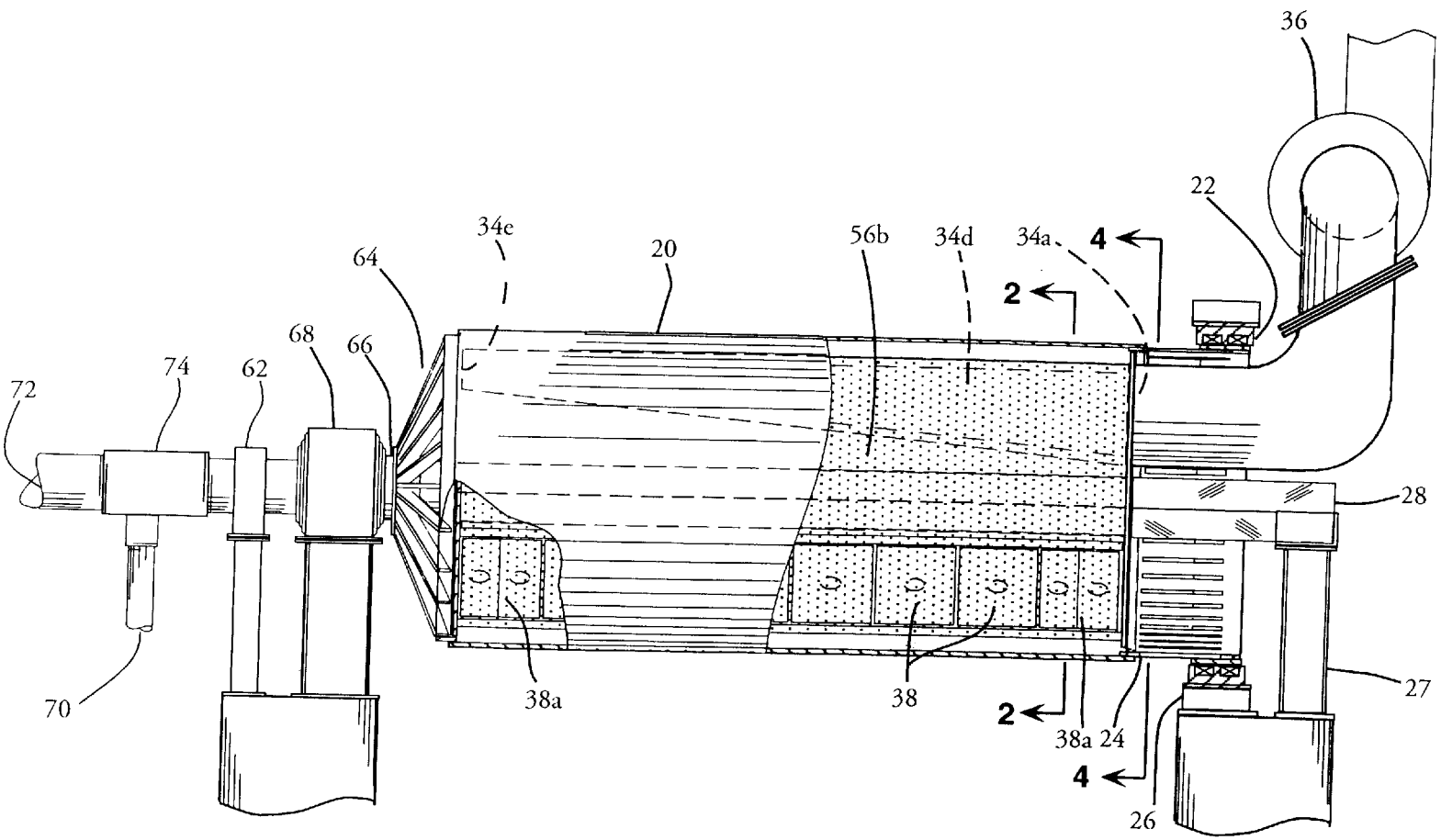
FIG. 5 is a modification of FIG. 1.

FIG. 5 is essentially a replica of FIG. 1; the same reference numerals are used for the same parts. The difference between FIGS. 1 and 5 is that the exhaust duct 34*d* in FIG. 5 has only one exhaust exit 34*a* and the bearing structure at the left extremity in FIG. 5 is simplified. The cross-section of exhaust manifold 34*d* increases progressively from end 34*e* to the exhaust end 34*a*.

In FIG. 5, structural tube 28 is carried by a fixed support 62. Cylinder 20 is supported by a heat-isolation collar 64, whose inner ends extend from journal 66. Bearing 68 supports journal 66 rotatably. Gaseous fuel is admitted to tube 28 by gas line 70 and mixing valve 74; air is admitted via tube 72 to mixing valve 74. (This air-fuel mixture supply arrangement may be used in FIG. 1.)

The form of apparatus of FIG. 5 is preferred over that of FIG. 1 for use where the length of the cylinder is small enough to function with an exhaust duct 34*d* that has only one exhaust end 34*a*.

Each of the two IR burners shown in FIG. 2 is a composite of multiple modules extending along and inside of cylinder 20. There is a distinct advantage to subdividing the IR burners into burner modules. As shown in FIG. 6, each module 38 may have its own valve 50 regulating its supply of air-fuel mixture. An electrical control 76 controls each valve 50, or in an alternative, control 76 may operate multiple valves 50. For example, the valves 50 that control the supply of air-fuel mixture to modules 38*a* at the ends of the cylinder serve to control the moisture content of the paper web at its margins, so that it may be satisfactory to use a common control 76 to regulate the air-fuel mixture supplied to the modules 38*a* at both ends of the cylinder. Sensor 78 may be the same as that in U.S. Pat. No. 5,276,327 (supra), or sensor 78 in the drawing may represent a succession of stationary sensors, cooperating with the paper web as it leaves the cylinder whose valves 50 are sensor-controlled, one stationary sensor for each burner module 38. Sensor 78 in either form controls the regulation of each valve 50 or judiciously selected valves 50 so as to increase or decrease the heat output of the cylinder opposite each burner module 38.

Figure 7:
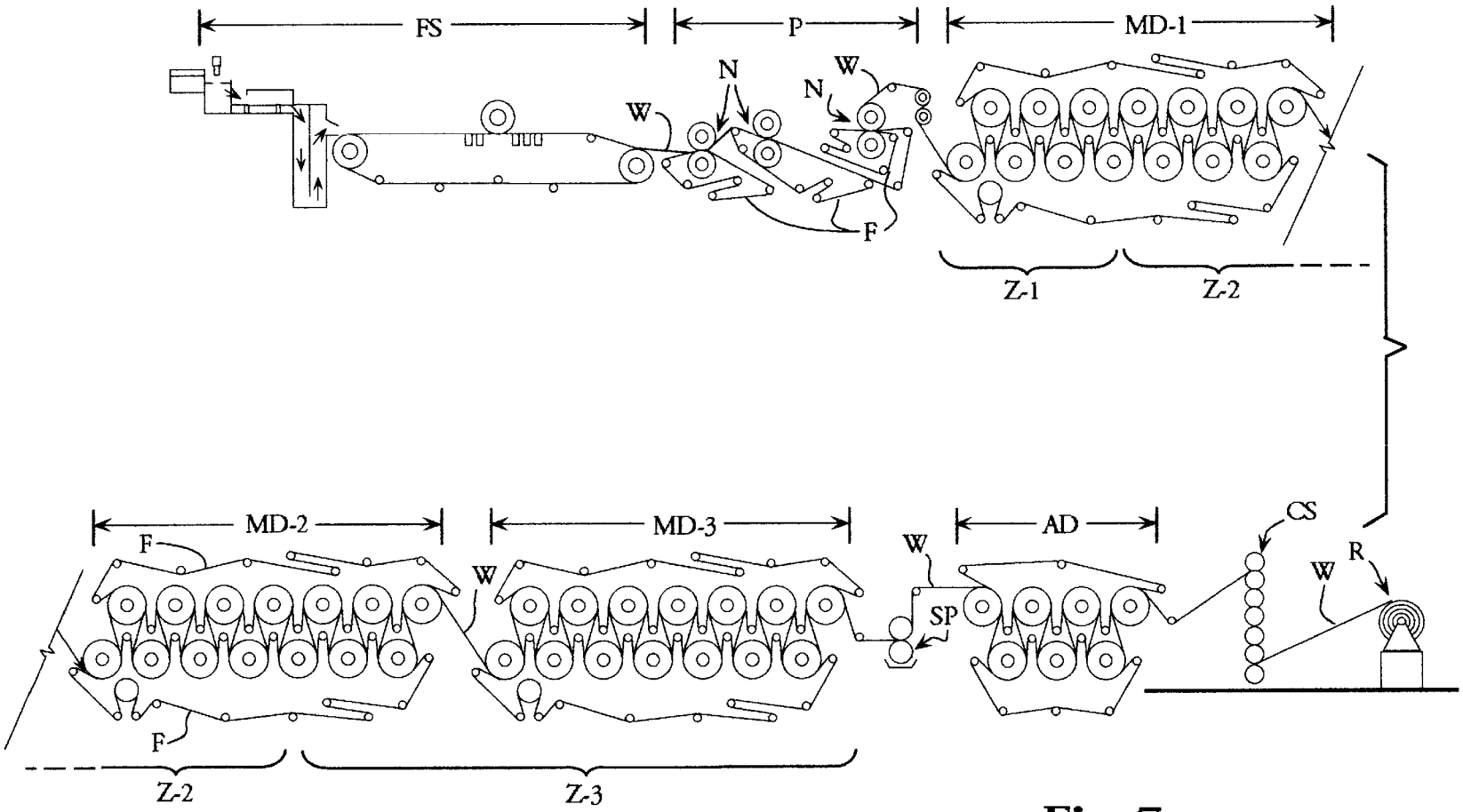
FIG. 7 is a diagrammatic view of an illustrative complete prior-art machine for making paper, serving also to make paperboard if certain portions are omitted.

FIG. 7 represents a conventional paper making machine whose dryer cylinders are heated by steam under pressure. FIGS. 8, 8A, and 9–13 represent modifications of portions of FIG. 7, improved by incorporating the apparatus of FIGS. 1–6 plus further improvements.

In FIG. 7, fibers are processed into a fibrous moisture-laden web W. The web thickness emerging from the forming section FS is regulated; its moisture content is typically 90%.

Web W is carried from the forming section FS and through the press section P by felts F. In the press section, multiple nip rollers N apply substantial pressure to squeeze moisture from the web and its felt backing. The water content of the web leaving the press section is typically in the range of 60% to 65%, depending on the thickness of the web being processed.

The web is then dried solely by evaporation in the main dryer sections, MD-1, MD-2, and MD-3 (FIG. 7). In increasing rate zone Z-1, the first 4 to 8 cylinders are used to raise the temperature of web W to about 160° F. (71° C.) the point where water begins to evaporate. Rapid moisture evaporation occurs in the constant rate zone Z-2, and evaporation progressively diminishes throughout the falling rate zone Z-3. This falling evaporation rate begins at about 40% web moisture. The falling rate is caused by a reduced capability of the web to conduct heat when its moisture content is low. Evaporative heating is transferred to and into web W by conduction from the cylinders. Effective heat transfer is promoted by firm contact of the web W with the cylinders.

Drying with somewhat higher-temperature cylinders at the end of the main dryer and afterdryer section is customary in steam-heated paper machine dryer sections. The steam delivered to the last set of dryers is at a highest pressure that is practical and safe, so that they achieve the highest cylinder surface temperatures in the entire dryer section. Sequentially lower-pressure steam is then cascaded to cylinders upstream along the web's path, in each set of dryer cylinders from the dry end to the wet end of the dryer section.

Depending on the grade of paper produced, the paper making machine may include a size press SP (represented diagrammatically) in which a dilute aqueous suspension of starch (for example) is applied to both sides of the web. The coating adds substantial moisture to the dry web. Afterdryers AD evaporate this additional moisture. On some paper machines, a calender stack CS is used to regulate the density and final sheet surface condition of the paper or paperboard being produced. The final product is wound on reel R.

The dryers of FIG. 7 are shown in the "double-tier" configuration of dryer cylinders arranged in upper and lower rows, with two felts F. The "single-tier" configuration (not shown) is an alternative. In a first series of cylinders of the single tier configuration, there is an upper row or "tier" of large-diameter dryer cylinders and a lower row of smaller-diameter suction "turn" cylinders. The web and the felt travel a sinuous path, alternating first around a dryer cylinder, then a turn cylinder, until the end of the series. In a following series, the row of small diameter suction turn cylinders is above the row or tier of large-diameter dryer cylinders. This pattern is reversed for series after series. Each dryer series has a single felt, which transports the web and constrains the web against the dryer cylinders through roughly 270° of contact.

Cylinders heated by internal IR burners, incorporating novel concepts of the heated cylinders of FIGS. 1–6, have a special value in paper making apparatus, both in replacing all steam-heated, web drying cylinders and as retrofit substitutes for particular cylinders in existing paper making machines, both in the single-tier and double-tier configurations. The maximum operating temperature of any replacement dryer cylinder can be predetermined for full-speed operation by specifying the arcuate extent of its IR burners.

FIGS. 8, 8A and 9–13 show dryer cylinders of the form in FIGS. 1–6 retrofitted into the papermaking apparatus of FIG. 7.

A newly formed web W leaving the press section P (FIG. 7) is relatively cold.

The main dryer section consists primarily of a succession of cylinders that are heated to dry the web by evaporation. In practice, the temperature of the first few cylinders of the main dryer section MD-1 is maintained relatively low. The function of those first few cylinders is only to raise the temperature of web W. If the cold web were to encounter too-hot cylinders, fibers tend to be pulled-out of the web and stick to the cylinder shell; this effect is called "picking". Fibers adhered to a hot cylinder surface impede the cylinder-to-web transfer of heat, thus impeding evaporative drying. Picking harms the surface of the end product, and it introduces a maintenance expense.

When thicker paperboard grades are bring dried, the temperature of the first drying cylinders of main dryer section MD-1 is also maintained relatively low to minimize too-rapid heating and potential delamination of the web, a tendency attributed in part to excessive heat trapped inside the web disturbing newly-formed internal fiber bonds. This is especially relevant for paperboard formed in multiple plies and those grades containing large proportions of recycled fiber.

In any case, the temperature of the first few cylinders of main dryer MD-1 is maintained comparatively low and, consequently, those cylinders contribute little to the drying process. To the extent that those cylinders might be operated at temperatures closer to the temperatures of the other dryer cylinders without causing "picking" or web delamination, overall utilization of the apparatus is improved. Moreover, it is difficult to maintain consistent cylinder heating at such low temperatures using steam.

Figure 8:
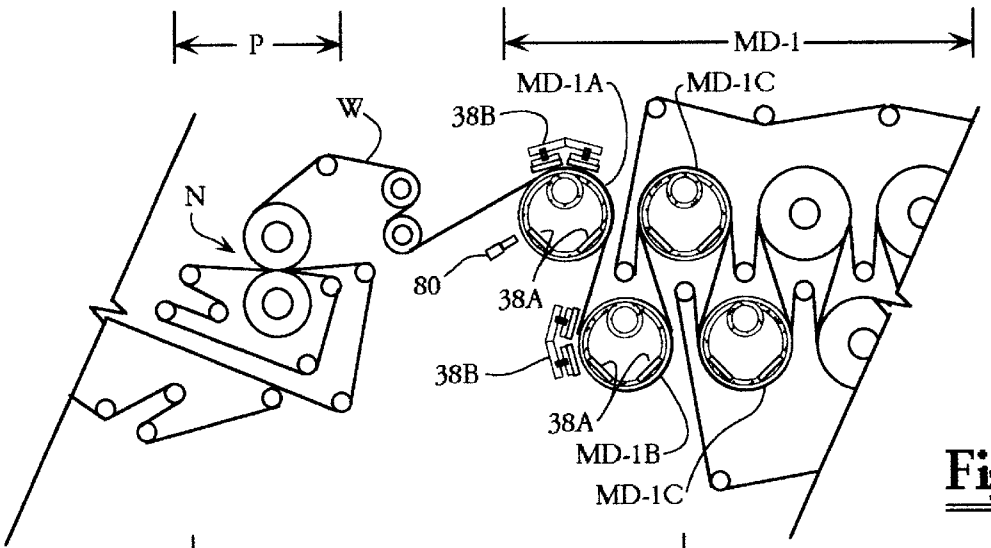
FIGS. 8, 8A and 9–13 show portions of FIG. 7, modified to include improvements shown in FIGS. 1—6 and further aspects of the invention.

FIG. 8 shows the transition in a conventional paper making machine of FIG. 7 from the press section P to the first main dryer section MD-1. The apparatus of FIG. 7 is improved by retrofitting main dryer MD-1 with novel web preheating cylinders MD-1A and MD-1B (FIG. 8). These cylinders are heated internally by IR burners as shown in FIGS. 1–6 and described above in detail; they are represented diagrammatically in FIG. 8.

Cylinders MD-1A and MD-1B are like the drying cylinders of FIGS. 1–6, with the following exceptions. First, the arcuate extent of their IR burners 38A is curtailed; a single row of IR burner modules 38A in each cylinder may suffice (instead of the two rows shown in FIGS. 2 and 8). At the full operating speed of the paper making machine, the arcuate extent of the IR burner or burners 38A in each cylinder is limited so as to develop a correspondingly limited cylinder temperature at which only tolerable picking by cylinders MD-1A and MD-1B occurs. Moreover, the web must be heated to a sufficiently high temperature so that excessive picking by the next following cylinder does not occur. As in FIGS. 1–6, IR burner 38A extends all along the cylinder, so as to heat the web W uniformly across its full width. However, the arcuate extent of burner 38A is relatively small; its area is only enough to develop the desired cylinder temperature to meet the criteria mentioned above when its supply of air-fuel mixture is at the maximum rate. As noted in connection with FIGS. 1–6, the "maximum" is that rate of supply at which combustion is sustained without lifting away from the surface of the IR burner.

Each cylinder MD-1A and MD-1B heats one side of the web W. The opposite side of web W is heated in FIG. 8 by external IR burners 38B, which are of the same construction as IR burner 38A. The heat of each IR burner 38B radiates directly to the web. Infrared heat, directly applied by IR burners 38B penetrates into the web. The purpose of using IR burners 38A and 38B at opposite sides of the web is to heat the web rapidly using non-contact, penetrating, heat while some web restraint is being supplied by the large area of contact of the web with the heated cylinder. In a modification (not shown) an IR burner might be disposed directly above web W where the web W approaches cylinder MD-1A. (See burner 38B' in FIG. 8A.)

A sensor 80 is mounted opposite the area of cylinder MD-1 that is exposed, i.e., not occupied by web W. That sensor may be of any suitable design, such as a light-sensitive element arranged to respond to reflection from the cylinder of light from a light source (not shown) forming part of sensor 80. Any accumulation of fibers picked from the web and stuck to the cylinder would scatter the incident light and reduce the light reaching the light-sensitive element.

The supply of air-fuel mixture to burners 38A and 38B may be regulated accurately in order to heat web W and cylinder MD-1A so that web W is warmed rapidly without causing more than a tolerable amount of picking. The temperature of the web should also be high enough to avoid excessive picking by the following dryer cylinders MD-1C. This regulation of the air-fuel mixture supplied to the burners may be responsive to sensor 80 or the regulation may depend on visual inspection of cylinders MD-1A and MD-1B. The desired burner operating temperatures for each particular grade processed can then be pre-set in a machine control recipe, using a programmable logic and/or distributive control scheme.

Cylinder MD-1B is equipped with corresponding IR burners 38A and 38B, proportioned and regulated in a manner described for cylinder MD-1A.

In operation of the apparatus, the supply of air-fuel mixture to burners 38A and 38B may be regulated over a range for adjustably limiting "picking".

Compared to the cumbersome and slow-response steam pressure regulation of the corresponding cylinders in a conventional paper making machine, the apparatus of FIG. 8 represents a distinctive advance.

Where the web is to be sized, it passes size press SP (FIG. 7) and enters afterdryers AD. A difficulty similar to "picking" arises at this point. The wet size coating on this web tends to adhere to the first cylinder or cylinders of the afterdryers AD. To combat that condition, the first few cylinders of the afterdryers are operated at a low temperature at which the size is "set". It is customary to avoid contact of the felt with the web until the size has been set. This portion of the conventional apparatus of FIG. 7 is improved in the manner illustrated in FIG. 8A pursuant to one aspect of the invention.

Figure 8A:
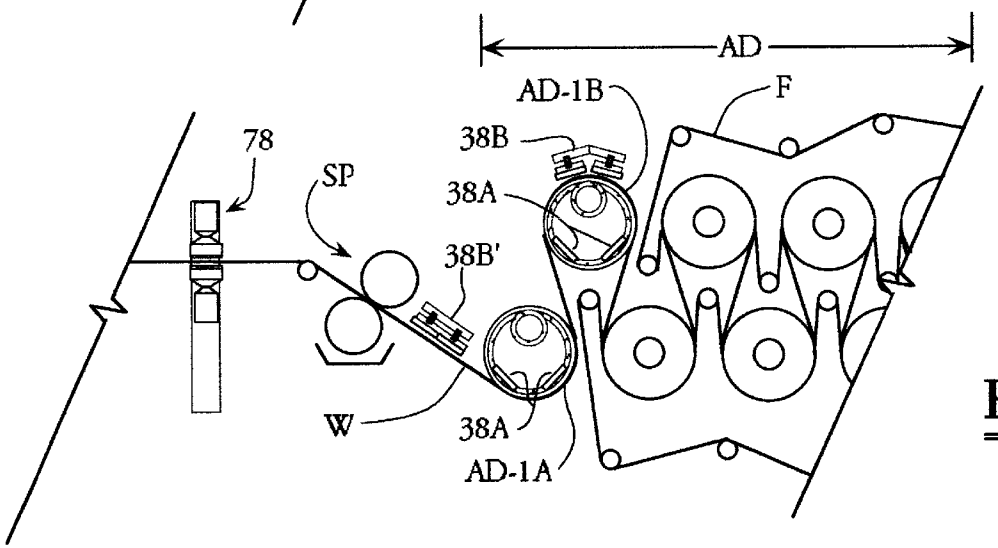

A profile scanner 78 (or a row of moisture sensors) is shown in FIG. 8A, this being part of the apparatus shown in FIG. 11 and discussed below. Web W leaves scanner 78 and passes through size press SP, where the aqueous size coating is applied.

In FIG. 8A, a stationary IR burner 38B' like burner 38 in FIG. 2 directs penetrating heat radiation directly to web W for setting the size at least somewhat. The web then contacts the first cylinders AD-1A and AD-1B of afterdryer AD. Cylinders AD-1A and AD-1B are of the same construction as the cylinder of FIG. 2; they are heated by an internal row or rows of IR burners 38A extending all along the respective cylinders.

As web W enters the afterdryers, it has been cooled in the size press SP. The first few cylinders of the afterdryers AD in FIG. 8A are operated at sufficiently low temperatures for setting the size coating without sticking onto the surface of the cylinders. For that purpose, the temperature of those cylinders is heated but maintained at comparatively low temperature. The temperatures of cylinders AD-1A and AD-1B are established at desired levels by appropriately proportioning their IR burner complements. Establishing and maintaining the desired cylinder temperatures at low values, even adjusting the temperatures somewhat by regulating the air-fuel supply to burners 38A, 38B, and 38B', provides an excellent mode of temperature control that is difficult to achieve with heating by steam. In FIG. 8A, web W does not encounter felt F until after the size has been set sufficiently, thus protecting the felt from contamination by web size.

Main dryer section MD-3 (FIG. 7) operates at the end of the falling rate zone. Afterdryer section AD also operates in a falling rate zone. The moisture content of the web is relatively low; the moisture evaporation rate declines toward the end of each dryer section MD-3 and AD. Noting that evaporation from the web depends on heat transfer by cylinder-to-web conduction of heat, and noting that the web develops more resistance to transfer of heat as it dries, it is desirable to operate at least the trailing series of cylinders in main dryer section MD-3 and the trailing series of cylinders of afterdryers AD at comparatively higher temperatures, higher surface temperatures than heretofore possible with steam-heated dryers.

Figure 9:
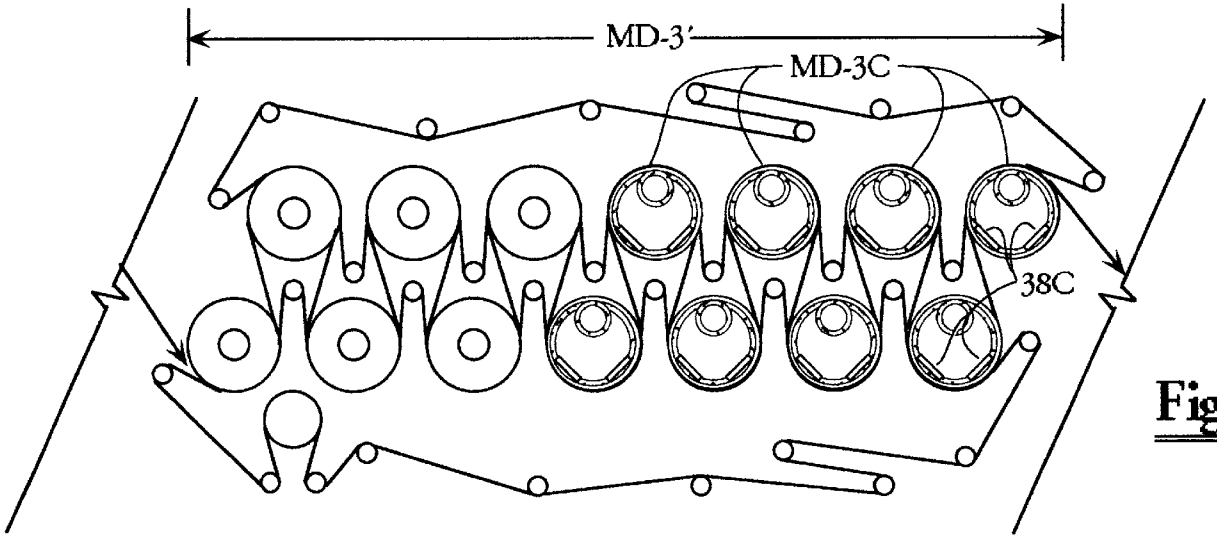

In FIG. 9, the trailing series of dryer cylinders MD-3C are diagrammatic representations of the dryer cylinders in FIGS. 1–6 when equipped with internal diagrammatically represented IR burners 38C. These novel dryer cylinders can be operated with significantly higher surface temperatures than the current steam-heated dryers. Such high temperatures of the trailing cylinders in the main dryer section MD-3 and afterdryer section AD, make a web speed increase possible, or alternatively, make it practical to reduce the number of cylinders required in sections MD-3 and AD.

The complement of IR burners 38C in each cylinder may be proportioned to have as large an arcuate extent as needed to produce the desired high cylinder surface temperature when the paper making machine is in full-speed operation and when IR burners 38C are supplied with air-fuel mixture at a maximum supply rate.

The high cylinder surface temperature that is attainable with cylinders heated internally by IR burners is adjustable to a significant degree, while reserving most of the burner turn-down range of adjustment for use during slowed operation of the apparatus. Notably, by appropriately proportioning the arcuate extents of the IR burners in the trailing series of cylinders, each cylinder can operate at its own optimal temperature. It is impractical or virtually impossible to operate each of a series of cylinders at its own optimal temperature when relying on steam heat.

Figure 10:
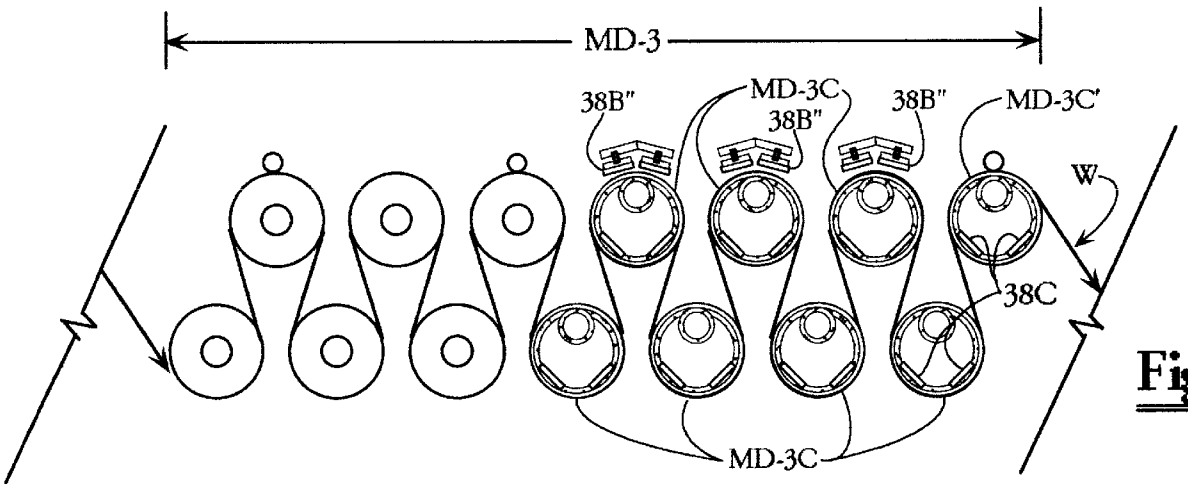

The trailing series of dryer cylinders MD-3C are diagrammatically represented in FIG. 10 which shows an alternative to FIG. 9. Dryer felts are omitted. This configuration is typically found on paper making machines processing thicker paperboard grades. These heavier webs do not require dryer felts for web transport. Unassisted, the web can maintain good contact with the heating surfaces of the cylinders. The dryer of FIG. 10 is retrofitted to have a series of cylinders heated by internal complements of IR burners. Cylinders MD-3C provide even more drying capacity to these hardest-to-dry heavyweight paperboard grades. Bottom dryer cylinders MD-3C and top dryer cylinders MD-3C and MD-3C' are the drying cylinders of FIGS. 1–6. As in FIG. 8, the side of web W opposite to top cylinders MD-3C is heated in FIG. 10 by external IR burners 38B". Each of the external IR heaters 38B" is of the same construction as IR burner 38C. The heat of each IR burner 38B" is applied directly to the web and a portion of that heat penetrates into the web. The purpose of using external IR burners 38B" and cylinders having internal IR burners 38C at opposite sides of the web is to provide direct non-contact, penetrating, heating simultaneously with high temperature conduction heating provided by the heated dryer cylinders.

With conduction heat transfer from a succession of cylinders, the outer surfaces of paperboard grades tend to dry first, leaving a wet center core at this dry end location in the dryer section. Paperboard making machines are typically dryer-limited for this reason, and this is one of the most demanding paper drying applications. This novel combination drying configuration provides an increased rate of heat transfer to the web W. The external direct IR heating provided by heaters 38B" penetrates the web surface and dries the wet core. Such high heat transfer to both sides of the thicker paperboard webs W in the trailing dryers in the main dryer section MD-3 and afterdryer section AD, make substantial web speed increases possible, or alternatively, make it possible to reduce the number of cylinders required in sections MD-3 and AD. Web W is sufficiently dried at this location and is unlikely to delaminate.

Figure 11:
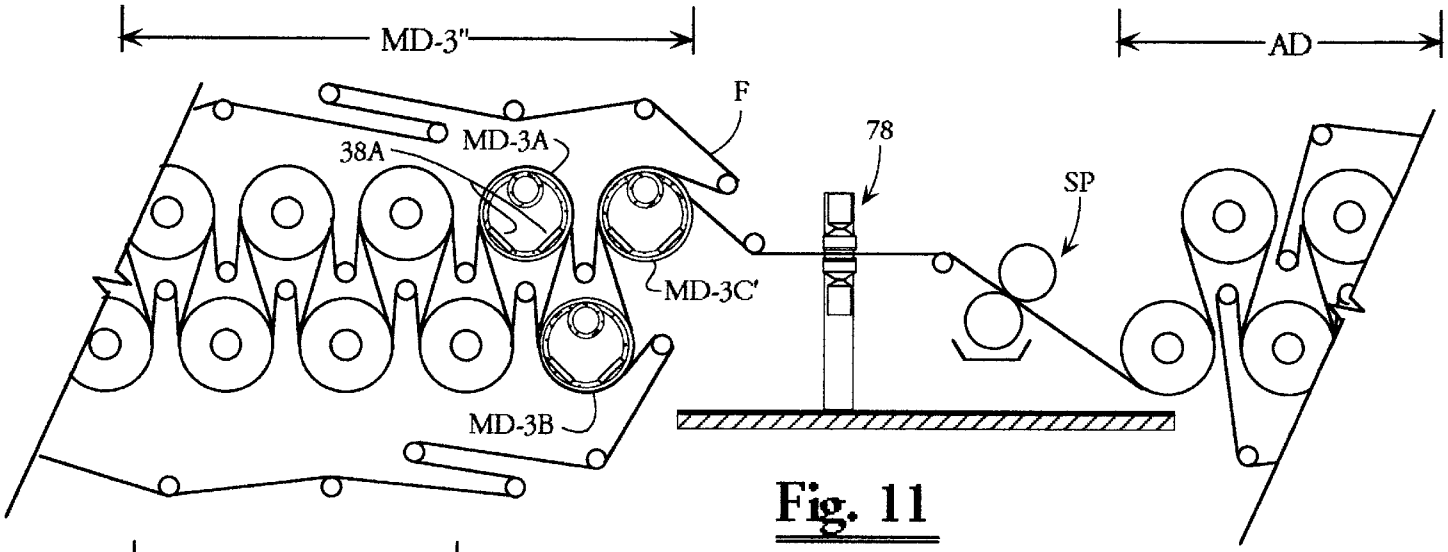

FIG. 11 illustrates an improvement in a portion of the apparatus of FIG. 7 for promoting cross-machine uniformity of the temperature and moisture content of the web on entering a diagrammatically represented size press SP. The size press coats the web with size, for example a highly diluted aqueous suspension of starch. The web entering the size press should have a uniform cross-machine profile of temperature and moisture content. The cross-machine moisture profile of the web is sensed by scanner 78 (see also FIG. 6 and the related description, above).

As is shown on FIG. 11, the web wraps around a substantial proportion of each of the heated cylinders of the dryer section MD-3". In the illustrative form of the apparatus shown, firm contact of the web with the cylinders is ensured by tensioned felt F, for promoting contact transfer of heat to the web. In apparatus designed for producing paperboard, the web (at this stage of the production process) has ample strength and it is under sufficient tension to maintain firm web-to-cylinder contact without dependence on the felt. Thus, the felt is only used where it is needed.

As seen in FIG. 11, two cylinders (for example) MD-3A and MD-3B are included in the third (last) main dryer section of the paper making apparatus, close to the end of this dryer section. Cylinders MD-3A and MD-3B are represented diagrammatically; they are the same as those shown in FIGS. 1–6 and described above in connection with those Figures. Cylinders MD-3A and MD-3B have internal IR burners 38A. Each IR burner 38A comprises at least one succession of IR burner modules, distributed lengthwise, in a row parallel to the cylinder's axis. Each module of the burner is to heat a respective band of its cylinder, for heating and drying a respective band or segment of the width of the web. These burner sections have respective valves (see valves 50 shown in FIG. 6) for regulating their supply of air-fuel mixture. Those valves are controlled adjustably by the scanner 78, being any suitable sensing apparatus that is responsive to the cross-machine moisture profile of the web.

Dryer section MD-3" (FIG. 11) includes a final cylinder MD-3C' engaged by the web following cylinders MD-3A and MD-3B; this cylinder may be heated in any suitable manner, uniformly in the cross-machine direction. Its purpose is to level the cross-machine temperature profile of the web; at times, the cross-machine temperature profile of the web is rendered non-uniform by cylinders MD-3A and MD-3B in their function of developing uniformity of the cross-machine moisture profile of the web. Cylinder MD-3C' irons out or levels the cross-machine temperature of the web.

The sequence of the cylinders and the scanner 78 as shown, is suitable and effective for promoting uniformity of the cross-machine profile of the web W entering the size press SP. Space limitations ordinarily preclude locating the scanner 78 directly opposite to the web along its path as it leaves the cylinders whose burner modules 38 are selectively controlled by the scanner. Locating scanner 78 at a position other than that shown is contemplated, if space should be available.

Figure 12:
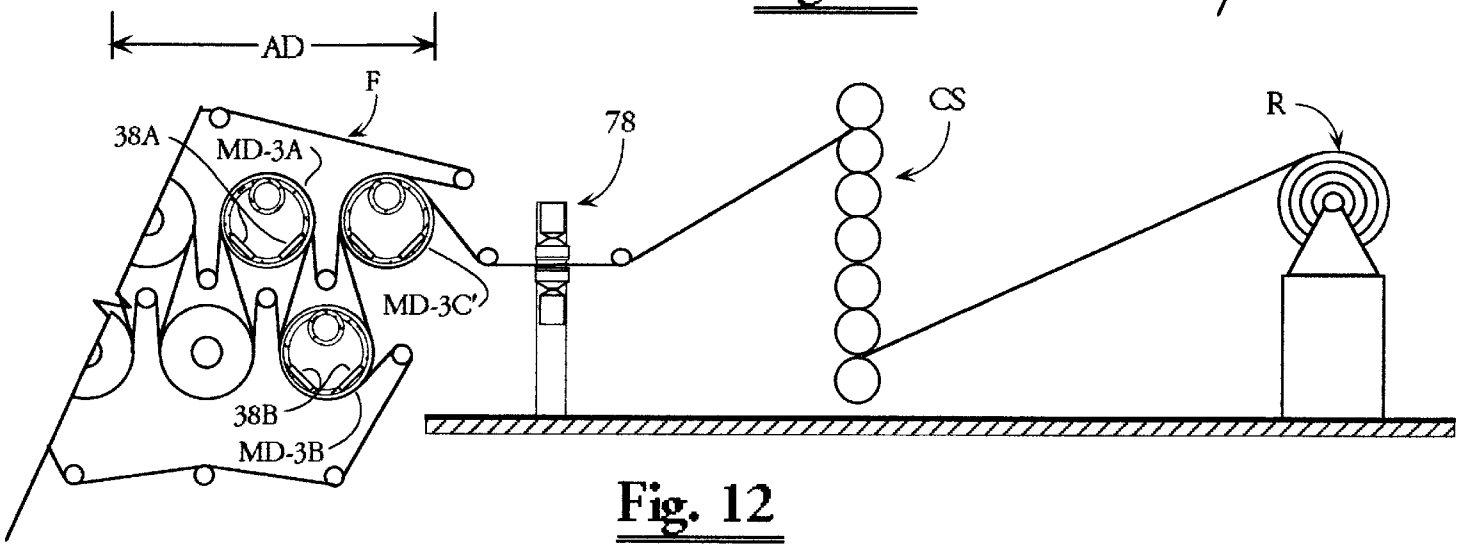

A conventional calender stack CS of FIG. 12 (see also FIG. 7) is commonly included in paper making machines for promoting uniformity of thickness and surface finish of paper or paperboard. As shown in FIG. 12, the same scanner 78 and cylinders MD-3A and MD-3B of FIG. 11, described above, may advantageously be included in the apparatus of FIG. 7, even if the size press is omitted as unnecessary. In the apparatus of FIG. 12, it may be deemed appropriate to omit temperature leveling cylinder MD-3C' following moisture-leveling cylinders MD-3A and MD-3B.

Figure 13:
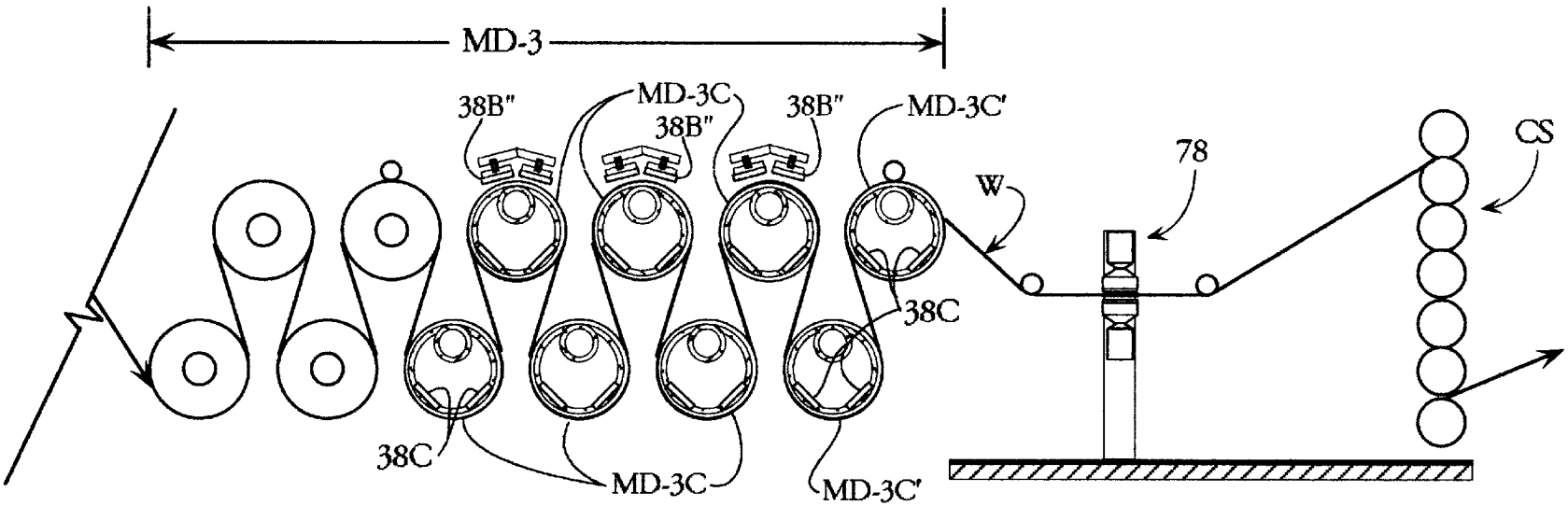

FIG. 13 represents an improved dryer combining aspects of the dryer sections of FIGS. 10 and 12. The reference characters used in FIG. 13 to designate its components are the same as those used in FIGS. 10 and 12 to designate the same components.

The upper and lower tiers of the cylinders in FIG. 13 are of the same construction as those in FIGS. 1·5 and 10. Each IR burner 38C in FIG. 13 comprises a series of IR burner modules extending in a row parallel to the axis of the cylinder. Manually adjustable valves, like valve 50 of FIG. 6, regulate the supply of air-fuel mixture to the IR burner modules of each dryer cylinder. They are adjusted empirically to heat their respective segments of the width of the web so as to impart desired heat to these segments.

The final cylinders MD-3C' have burner modules that develop uniform temperature of the cylinder in the cross-machine direction, to produce a "leveling" effect discussed at various parts of the foregoing text.

In FIG. 13, external dryers 38B" comprise IR burner modules distributed in a row across the web (parallel to the axes of respective cylinders). Each module heats a corresponding segment of the web's width. The radiant heat from the IR burners penetrates into the web, some of it passing through the web. Absorption of heat by each segment of the web's width is directly related to its moisture content; i.e., more heat is absorbed by relatively moist segment of the web's width than by a dryer segment. The resulting drying effect does not depend on heat conduction from the exterior of the web to its innermost stratum. Conduction of heat would take a finite time interval, which is a significant consideration where, as here, the web travels at high speed. Penetration of the radiant heat into the web from burner modules 38B" is instantaneous.

In common with FIG. 12, FIG. 13 includes a moisture profile sensor 78, optionally in the form of a scanner. It senses the cross-machine profile of the web after the web has passed cylinders MD-3C' and external heaters 38B". Sensor 78 in FIG. 13 is arranged to adjust valves (such as valves 50 in FIG. 6) to develop a uniform cross-machine moisture profile of the web.

The term "uniform" is not intended as a restrictive term; any desired moisture profile may be developed. For example, it might be considered desireable to develop slightly higher moisture content in the web at its margins compared to the area of the web between its margins. The described dryer is flexible in that respect.

IR burners 38B" (FIG. 13) impart their drying effect without making contact with the web. Such dryers do not depend on cylinder-to-web contact for heat transfer, as is true of apparatus such as those in FIGS. 11 and 12 for example. In those examples, while the cylinder is hot and is accordingly an emitter of some heat radiation, the cylinder wall shields the web from direct infrared emission from the IR burners inside the cylinder.

It may be noted that sensor 78 is located downstream relative to "leveling" cylinder MD-3C'. Sensor 78 modifies the operation of the IR burner modules in external heaters 38B" to correct undesired deviations in the cross-machine profile of the web, should such deviations persist after the web passes leveling cylinders MD-3C'.

The IR burner modules of external heaters 38B" are distinctive; they provide regulated, non-contact instantaneous heating that penetrates into the web and promotes drying in the bulk of the webs such as paperboard.

Some of the radiation from IR burners 38B" may pass through the web entirely, adding to the heat of the cylinder underlying the web. If the cylinder were heated by steam as is customary, the web-penetrating heat could raise the temperature and the steam pressure to a hazardous level. Here to the extent that the radiant heat from an external heater reaches an underlying cylinder, it merely contributes to the intended effect.

The fact that the operation of the IR burner modules in the cylinders and in the external heaters is readily regulated is an asset. The heat of each cylinder and the heat of each related external IR burner can be readily coordinated.

FIGS. 8, 8A and 9–13 illustrate advantageous changes that may be realized in paper making machines by replacing particular steam-heated cylinders with cylinders in the form in FIGS. 1–6. Such substitutions may actually be carried out by modifying existing paper making apparatus in retrofitting such apparatus with novel cylinders equipped with IR burners. In any retrofitting program, consideration should be given to increasing the speed of the apparatus (made possible by substitution of the new cylinders) or removing some of the cylinders rendered unnecessary by the novel cylinders.

The illustrative embodiments of the invention shown in the drawings incorporate various novel features, some of which may be omitted, together with their function, while other novel features and their advantages are retained. Additional modifications of the illustrative embodiments as shown may be adopted by those skilled in the art within the spirit and scope of the invention. Consequently, the invention should be construed broadly, in accordance with its true spirit and scope.

What is claimed is:

1. A gas-fired drying cylinder comprising a cylindrical shell, means for supporting each end of the shell, said shell having an internal surface and having an external surface for engagement with material to be heated, means for mounting the shell for rotation about its central longitudinal axis; a burner assembly non-rotatably supported within said shell and located adjacent to the internal surface of the shell for burning air-fuel mixture to transfer heat to the shell by infrared radiation and by convection of hot combustion gases; said burner assembly having a plurality of burner segments along the length of the shell, the heat output of the burner segments being individually controllable and being selectively controllable for operation in unison, the mounting means of said shell at least at one end thereof being adapted to provide access to said burner assembly for removal thereof through an end of the shell.

2. Apparatus for heat-treating a web, including a rotary cylinder heated by internal IR burners, the web being wrapped partway around the cylinder, at least one external heater comprising external IR burner modules disposed to direct infrared radiation towards that side of the web which is opposite to the side of the web in contact with said cylinder; said external heater comprising a succession of external IR burner modules extending across the web, each of said external modules being disposed to radiate heat at a corresponding segment of the width of the web, said external heater being disposed to direct infrared web-penetrating radiation at a segment of the width of the web that is in contact with said cylinder, means for sensing the cross-machine moisture profile of the web, and means responsive to said sensing means for regulating the operation of said modules, so as to promote a desired cross-machine moisture profile of the web.

3. A gas-fired drying cylinder comprising a rotary cylindrical shell having an outer surface for engagement with material to be heat-treated and having an inner surface, means at each end of the shell for supporting the shell for rotation about its central longitudinal axis; a burner assembly having multiple IR burner segments distributed along the length of the shell for heating corresponding annular segments of the shell as the shell rotates, said burner assembly being non-rotatably disposed within said cylindrical shell, each burner segment having a porous emitter at the front thereof facing said inner surface of the shell and having a plenum at the rear of the emitter for supplying air-fuel mixture to the emitter, the front of each said emitter being incandescent and emitting hot gaseous exhaust during operation for heating said shell by infrared radiation from the emitter and by convection of the exhaust about the inner surface of said shell, said burner assembly including valves having control means for regulating the heat output of said burner segments selectively and for regulating the heat output of said burner segments collectively, the supporting means at least at one end of the shell being adapted to provide access to said burner assembly for removal thereof through an end of said cylindrical shell.

4. A gas-fired drying cylinder comprising a cylindrical shell, means for supporting each end of the cylinder, said shell having an internal surface and having an external surface for engagement with material to be heated, said drying cylinder being mounted for rotation about its central longitudinal axis; a burner assembly non-rotatably disposed within said cylinder and located adjacent to the internal surface of the cylinder for burning air-fuel mixture to transfer heat to the dryer shell by infrared radiation and by convection of hot combustion gases; said burner assembly having a plurality of burner segments along the length thereof, the heat output of the burner segments being individually controllable or controllable in unison, the supporting means at least at one end of the cylinder being adapted to provide access to said burner assembly for removal thereof through an end of the cylinder.

5. Apparatus for heat-treating a web, including multiple rotary cylinders having internal IR burners, the web being wrapped partway around the cylinders successively and one side of the web being in contact with each of the cylinders at least one external heater comprising IR burner modules disposed to direct infrared radiation toward that side of the web opposite to that side of the web which is in contact with one of said cylinders, said external heater comprising a succession of IR burner modules extending across the web, each of said modules being disposed to radiate heat at a corresponding segment of the width of the web, means for sensing the cross-machine moisture profile of the web, and the means responsive to said sensing means for regulating the operation of said modules, so as to promote a desired cross-machine moisture profile of the web.

6. Apparatus as in claim 5, wherein said external heater is disposed to direct radiation at a portion of the web that is in contact with said cylinder.

7. Apparatus as in claim 5, wherein said sensing means is disposed to sense the web at a location downstream of the location of said external heater.

8. Apparatus as in claim 5, wherein sad cylinders include upper and lower rows of cylinders, said web being wrapped partway around said upper and lover cylinder alternately with arcs of the web wrapped around upper portions of the upper row of cylinders, said apparatus including multiple external heaters disposed opposite to respective cylinders of the upper row, at least one of said external heaters being responsive to said sensing means as aforesaid.

9. Apparatus for heat-treating webs, including a rotary cylinder operable about a horizontal axis and having an outer web-engaging surface and an inner prominently heat-absorbing surface, and a stationary structure within the cylinder including one or more IR burners each of which has an emitter of gas-permeable material whose outer surface is characteristically incandescent when in operation, each such outer emitter surface confronting but being separated by an exhaust-gas receiving space from said inner heat-absorbing surface, and each said emitter having a plenum at its inner surface for containing air/fuel mixture, said stationary structure including a generally cylindrical wall that is constituted, in part, of said IR burner or burners, said wall bounding circumferentially a core volume of said stationary structure, the wall separating said core volume from said exhaust-gas receiving space, and means for replacing air from said core volume with cooler air, for thereby avoiding a build-up of heat in said core volume.

10. Apparatus for heat-treating webs, including a cylinder mounted for rotation about a horizontal axis and having an outer surface for engagement by a web to be heat-treated and an inner prominently heat-absorbing surface, drive means for rotating the cylinder, a stationary structure within the cylinder having an IR burner complement which extends essentially end-to-end of the cylinder, said IR burner complement being of the type having an emitter of gas-permeable material and a plenum behind the emitter for providing the rear of the emitter with a supply of air-fuel mixture, the front or combustion surface of the emitter being characteristically incandescent when in operation, said combustion surface confronting but being separated by an exhaust-gas receiving space from said inner heat-absorbing surface and the area of said combustion surface being limited so as to confront substantially less than the area of said inner heat-absorbing surface, only that portion of the cylinder's inner surface which is confronted by the combustion surface being heated thereby instantaneously by radiation, all of the cylinder's inner surface being heated by radiation from said combustion surface during rotation of the cylinder, an exhaust duct in said stationary structure having an opening into said exhaust-gas receiving space, heat tending to build up and potentially overheat the stationary structure during operation of the apparatus, said apparatus having means for inhibiting build-up of heat in said stationary structure including heat-shielding material covering that portion of the outer or peripheral area of the stationary structure which is not occupied either by said IR burner complement or by the opening of said exhaust duct into said exhaust-gas receiving space, said heat-shielding material confronting said heat-absorbing surface for intercepting heat that may be re-radiated from said heat-absorbing surface to the stationary structure.

11. Apparatus as in claim 10, wherein said opening of the exhaust duct receives exhaust gas from said exhaust gas receiving space, said apparatus further including means for drawing exhaust gas out of the exhaust duct, the interior of said stationary structure having space occupied by resident air which tends to become heated/during operation of the apparatus, said exhaust duct having inlet passage means along its length for admitting and thereby removing heated resident air from said stationary structure, and said apparatus having means for introducing make-up air to replace resident air removed from said stationary structure.

* * * * *